US007735182B2

(12) United States Patent
Morris et al.

(10) Patent No.: US 7,735,182 B2
(45) Date of Patent: Jun. 15, 2010

(54) MOP ASSEMBLY WITH REVERSIBLE HEAD

(75) Inventors: Cameron Ray Morris, Cumming, GA (US); Stephanie Ann Rossignol, Cumming, GA (US); George Nukuto, Neenah, WI (US); Denis R. Grimard, Appleton, WI (US); Carl G. Rippl, Appleton, WI (US); MeeWha Lee, Appleton, WI (US); Paul Woon, Alpharetta, GA (US); Russell J. Kroll, Atlanta, GA (US); Mark Londborg, Atlanta, GA (US); Robert Henshaw, Newnan, GA (US); Kiran K. Reddy, Roswell, GA (US); Thomas Glenn Merrill, Cumming, GA (US); Jose Ricardo Rubio-Flores, Jr., Roswell, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1001 days.

(21) Appl. No.: 11/458,108

(22) Filed: Jul. 18, 2006

(65) Prior Publication Data

US 2008/0016638 A1 Jan. 24, 2008

(51) Int. Cl.
*A47L 13/256* (2006.01)

(52) U.S. Cl. ..... 15/228; 15/144.2; 15/145; 15/115; 15/118; 15/147.2; 15/231

(58) Field of Classification Search ..... 15/114, 15/115, 118, 144.1, 144.2, 145, 147.1, 147.2, 15/228, 231
See application file for complete search history.

(56) References Cited

U.S. PATENT DOCUMENTS

| | | | |
|---|---|---|---|
| 1,605,008 | A | 11/1926 | Smith |
| 1,609,414 | A | 12/1926 | Lenny |
| 2,328,287 | A | 8/1943 | Martin |
| 2,900,652 | A | 8/1959 | Kautenberg |
| 3,203,029 | A | 8/1965 | Serio |

(Continued)

FOREIGN PATENT DOCUMENTS

| | | | |
|---|---|---|---|
| DE | 19908259 | A1 | 8/2000 |

(Continued)

OTHER PUBLICATIONS

Patent Abstracts of Japan, JP 08228985 A, Sep. 10, 1996.

(Continued)

*Primary Examiner*—Mark Spisich
(74) *Attorney, Agent, or Firm*—Nathan P. Hendon

(57) ABSTRACT

A reversible mop head assembly for use with a mop handle is disclosed. The mop head assembly includes a transverse support shaft, a pair of end caps positioned at opposite ends of the transverse support shaft, a pair of opposed substrate support surfaces positioned between and supported by the end caps, and a head mount coupled to the transverse support shaft centrally between the end caps.

20 Claims, 11 Drawing Sheets

U.S. PATENT DOCUMENTS

| | | | |
|---|---|---|---|
| 3,208,318 | A | 9/1965 | Roberts |
| 3,221,356 | A | 12/1965 | Schimer |
| 3,395,415 | A | 8/1968 | Leland |
| 3,605,161 | A | 9/1971 | Moss et al. |
| 3,692,618 | A | 9/1972 | Dorschner et al. |
| 3,737,938 | A | 6/1973 | Saltzstein |
| 3,778,860 | A | 12/1973 | Thielen |
| 3,792,505 | A | 2/1974 | Saltzstein |
| 3,837,031 | A | 9/1974 | Allaire et al. |
| 3,849,241 | A | 11/1974 | Butin et al. |
| 3,850,533 | A | 11/1974 | Thielen |
| 4,041,203 | A | 8/1977 | Brock et al. |
| 4,114,223 | A | 9/1978 | Buchanan |
| 4,225,998 | A | 10/1980 | Thielen |
| 4,247,216 | A | 1/1981 | Pansini |
| 4,340,563 | A | 7/1982 | Appel et al. |
| 4,353,142 | A | 10/1982 | Nishiyama et al. |
| 4,433,931 | A | 2/1984 | Malish et al. |
| 4,685,167 | A | 8/1987 | Murray |
| 4,763,377 | A | 8/1988 | Madsen |
| 4,819,293 | A | 4/1989 | Nicholson |
| 4,852,210 | A | 8/1989 | Krajicek |
| 4,962,682 | A | 10/1990 | Rose et al. |
| 5,071,489 | A | 12/1991 | Silvenis et al. |
| 5,145,727 | A | 9/1992 | Potts et al. |
| 5,169,706 | A | 12/1992 | Collier, IV et al. |
| 5,178,931 | A | 1/1993 | Perkins et al. |
| 5,188,885 | A | 2/1993 | Timmons et al. |
| 5,207,754 | A | 5/1993 | Harrah |
| 5,253,387 | A | 10/1993 | Kresse et al. |
| 5,288,161 | A | 2/1994 | Graves et al. |
| D348,827 | S | 7/1994 | Berti et al. |
| 5,343,587 | A | 9/1994 | Findley |
| 5,375,286 | A | 12/1994 | Harrah |
| 5,379,478 | A | 1/1995 | Vosbikian |
| 5,394,594 | A | 3/1995 | Duran |
| 5,402,559 | A | 4/1995 | Allison et al. |
| 5,419,015 | A | 5/1995 | Garcia |
| 5,442,830 | A | 8/1995 | Ohm |
| 5,455,980 | A | 10/1995 | Buchanan |
| 5,461,749 | A | 10/1995 | Ahlberg et al. |
| D366,740 | S | 1/1996 | Clausen et al. |
| 5,487,202 | A | 1/1996 | Cowan |
| 5,522,648 | A | 6/1996 | Wilen |
| 5,581,839 | A | 12/1996 | Ferrell, Jr. |
| 5,701,628 | A | 12/1997 | Morad |
| 5,740,578 | A | 4/1998 | Moore |
| D398,724 | S | 9/1998 | Kohlruss et al. |
| 5,842,810 | A | 12/1998 | Morad |
| 5,876,141 | A | 3/1999 | Hsu |
| 5,901,402 | A | 5/1999 | Williams |
| 5,911,258 | A | 6/1999 | Morad |
| 5,920,944 | A | 7/1999 | Biggs et al. |
| 5,937,471 | A | 8/1999 | Liao |
| 6,023,812 | A | 2/2000 | Morad |
| 6,061,864 | A | 5/2000 | Ensson |
| 6,119,298 | A | 9/2000 | Kenmochi |
| 6,212,917 | B1 | 4/2001 | Rathbun |
| 6,237,182 | B1 | 5/2001 | Cassar |
| 6,298,517 | B1 | 10/2001 | McKay |
| 6,305,046 | B1 | 10/2001 | Kingry et al. |
| 6,354,666 | B1 | 3/2002 | Atkins et al. |
| D458,722 | S | 6/2002 | Romero et al. |
| 6,405,403 | B1 | 6/2002 | McKay |
| D465,890 | S | 11/2002 | Rivera et al. |
| 6,484,346 | B2 | 11/2002 | Kingry et al. |
| 6,513,199 | B1 | 2/2003 | Cheng |
| 6,654,980 | B2 | 12/2003 | Biggs |
| 6,684,446 | B2 | 2/2004 | Salmon |
| 6,736,034 | B1 | 5/2004 | Gonzales |
| 6,745,427 | B1 | 6/2004 | Trenz et al. |
| 6,810,554 | B2 | 11/2004 | McKay |
| 6,820,301 | B2 | 11/2004 | Petner |
| 6,842,936 | B2 | 1/2005 | Policicchio et al. |
| 6,854,919 | B2 | 2/2005 | Neumann et al. |
| 6,871,372 | B2 | 3/2005 | Vosbikian et al. |
| 6,889,917 | B2 | 5/2005 | Fahy et al. |
| 6,925,686 | B2 | 8/2005 | Heathcock et al. |
| 6,953,299 | B2 | 10/2005 | Wang et al. |
| 6,976,282 | B2 | 12/2005 | Sie |
| 6,986,618 | B2 | 1/2006 | Hall et al. |
| 7,065,825 | B2 | 6/2006 | Minkler et al. |
| 2001/0009632 | A1 | 7/2001 | Cross |
| 2002/0042962 | A1 | 4/2002 | Willman et al. |
| 2003/0009839 | A1 | 1/2003 | Streutker et al. |
| 2003/0028988 | A1 | 2/2003 | Streutker et al. |
| 2003/0084531 | A1 | 5/2003 | Dingert et al. |
| 2003/0110584 | A1 | 6/2003 | Clare et al. |
| 2003/0221274 | A1 | 12/2003 | Makhija et al. |
| 2004/0068817 | A1 | 4/2004 | Policicchio |
| 2004/0074520 | A1 | 4/2004 | Truong et al. |
| 2004/0088808 | A1 | 5/2004 | Vitantonio et al. |
| 2004/0182952 | A1 | 9/2004 | Soller et al. |
| 2004/0188539 | A1 | 9/2004 | Soller et al. |
| 2004/0244131 | A1 | 12/2004 | Cassar |
| 2004/0244133 | A1 | 12/2004 | Li |
| 2004/0255418 | A1 | 12/2004 | Minkler et al. |
| 2005/0011536 | A1 | 1/2005 | Hofte et al. |
| 2005/0060827 | A1 | 3/2005 | James et al. |
| 2005/0066465 | A1 | 3/2005 | Minkler et al. |
| 2005/0097691 | A1 | 5/2005 | Tsuchiya et al. |
| 2005/0102781 | A1 | 5/2005 | Tsuchiya et al. |
| 2005/0251941 | A1 | 11/2005 | Berhoff |
| 2005/0251943 | A1 | 11/2005 | VanLandingham, Jr. |
| 2005/0265769 | A1 | 12/2005 | Blom |
| 2005/0283933 | A1 | 12/2005 | Mitchell et al. |
| 2005/0285387 | A1 | 12/2005 | Suda et al. |
| 2006/0000041 | A1 | 1/2006 | Streutker et al. |
| 2006/0048327 | A1 | 3/2006 | Lacotta et al. |
| 2006/0075587 | A1 | 4/2006 | Broman |
| 2006/0191557 | A1 | 8/2006 | Rosenzweig et al. |

FOREIGN PATENT DOCUMENTS

| | | | |
|---|---|---|---|
| DE | 10003899 | | 9/2001 |
| EP | 0697269 | A2 | 2/1996 |
| EP | 0980667 | A2 | 2/2000 |
| EP | 0811350 | B1 | 11/2000 |
| EP | 0966222 | B1 | 9/2003 |
| EP | 1591053 | A1 | 11/2005 |
| GB | 2259474 | | 3/1993 |
| WO | WO 88/01845 | | 3/1988 |
| WO | WO 99/49755 | A1 | 10/1999 |
| WO | WO 99/60913 | | 12/1999 |
| WO | WO 03/039321 | | 5/2003 |
| WO | WO 2004/071266 | | 8/2004 |
| WO | WO 2005/084516 | | 9/2005 |
| WO | WO 2006/002653 | | 1/2006 |

OTHER PUBLICATIONS

Patent Abstracts of Japan, JP 10276953 A, Oct. 20, 1998.
Patent Abstracts of Japan, JP 2001309881 A, Nov. 6, 2001.
Patent Abstracts of Japan, JP 2002102132A, Apr. 9, 2002.
Lawrence, K.D. et al., "An Improved Device for the Formation of Super-Fine Thermoplastic Fibers," *NRL Report 5265*, Feb. 11, 1959.
Wendt, B.A. et al., "Manufacture of Superfine Organic Fibers", *NRL Report 4364*, May 25, 1954.

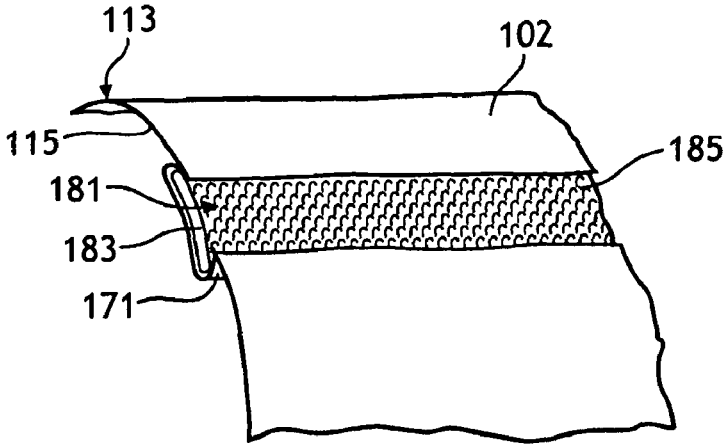
FIG. 4
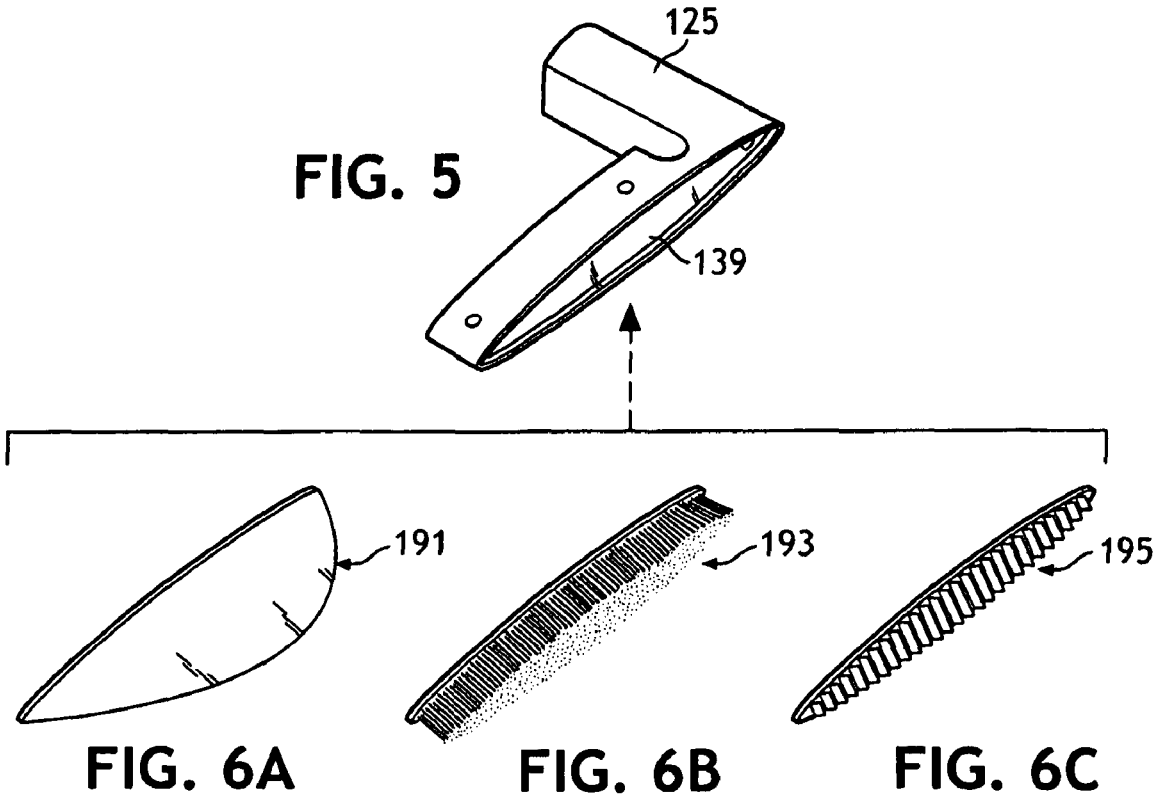
FIG. 5
FIG. 6A FIG. 6B FIG. 6C

MOP ASSEMBLY WITH REVERSIBLE HEAD

BACKGROUND

Various versions of floor mops are commonly available for the variety of cleaning needs in both commercial and domestic consumer environments. For example, cotton string floor dust mops are commonly seen cleaning the dust and debris from school and public building hallways. One problem with such cotton string dust mops is that the dirt and debris can build up in the cotton substrate. Such mop heads need to be regularly cleaned or replaced. Cleaning or replacing the substrate can be cumbersome and may result in significant added cost to the user.

Smaller versions of such dust mops are readily available for consumer home use and utilize disposable cleaning substrates that are applied to the mop head. The disposable cleaning substrate is most commonly wrapped across the floor-contacting surface of such mop heads and both of the substrate's free ends are clamped, grasped or otherwise attached to the upper surface of the mop head. Such disposable substrates also need to be regularly replaced as the substrate become soiled in use, however the substrate is easier to replace than the cotton string substrate of commercial dust mops.

A problem with such consumer dust mops that use disposable cleaning substrates is an inefficiency in the use of such disposable substrates. First, the substrate surface that comes into contact with the floor is the only surface that is used for cleaning; the sections of the substrate that are wrapped over the top surface of the mop head to hold the substrate in place are not used in cleaning. Secondly, the design of most available consumer dust mops have a flat bottom surface that the substrate is held against. Such a design results in more dust and debris being collected along the front edge of the substrate rather than utilizing the entire substrate surface. Finally, such substrates need to be replaced after this relatively small effective cleaning area of substrate becomes soiled.

Some have tried to address the inefficiency of the disposable cleaning substrate by utilizing a reversible mop head design. Such reversible designs use a disposable cleaning substrate on both the top and bottom surfaces of the dust mop such that the mop head can be flipped over to either side for cleaning. The use of a reversible design increases the amount of time that such a dust mop can be used in comparison to the single-sided dust mop discussed above. However, such mops still have the issues of substrate surface that is wasted to fastening the substrate to the mop and inefficient substrate use due to a flat head design, as described above.

Additionally, the design of such reversible dust mops may have their own unique problems. Designs that include a handle mount in the center of the head require a cutout in the head and in the substrate to allow the head to be flipped over. Such cutout area can then not effectively be used for supporting the cleaning substrate. One solution to such a problem has been the use of a head mount that connects the handle to the end of the mop head such that the handle is in a cantilevered position, similar in configuration to that of a traditional paint roller head and handle. However, such a cantilevered design does not have the mop control of a traditional floor dust mop where the handle is mounted in the center of the mop head; in use, such a head mount can flex with force applied to the handle and make control of the mop head difficult.

Secondly, while such designs provide a partial solution to the issue of substrate wasted to fastening the substrate to the mop head, they present their own unique challenge as to how to fasten such a substrate to the reversible head.

DEFINITIONS

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together.

As used herein, the term "couple" includes, but is not limited to, joining, connecting, fastening, linking, or associating two things integrally or interstitially together.

As used herein, the term "configure(s)", "configured" or "configuration(s)" means to design, arrange, set up, or shape with a view to specific applications or uses. For example: a military vehicle that was configured for rough terrain; configured the computer by setting the system's parameters.

As used here, the term "operable" or "operably" means being in a configuration such that use or operation is possible. Similarly, "operably connect(s)" or "operably connected" refers to the relation of elements being so configured that a use or an operation is possible through their cooperation. For example: the machine is operable; the wheel is operably connected to the axle.

As used herein, the term "hinge" refers to a jointed or flexible device that connects and permits pivoting or turning of a part to a stationary component. Hinges include, but are not limited to, metal pivotable connectors, such as those used to fasten a door to frame, and living hinges. Living hinges may be constructed from plastic and formed integrally between two members. A living hinge permits pivotable movement of one member in relation to another connected member.

As used herein, the term "substantially" refers to something which is done to a great extent or degree; for example, "substantially covered" means that a thing is at least 95% covered.

As used herein, the term "alignment" refers to the spatial property possessed by an arrangement or position of things in a straight line or in parallel lines.

As user herein, the terms "orientation" or "position" used interchangeably herein refer to the spatial property of a place where or way in which something is situated; for example, "the position of the hands on the clock."

As used herein the terms "nonwoven fabric", "nonwoven material", or "nonwoven web" means a web having a structure of individual fibers or threads which are interlaid, but not in an identifiable manner as in a knitted fabric. Nonwoven fabrics or webs have been formed from many processes such as for example, meltblowing processes, spunbonding processes, and bonded carded web processes. The basis weight of nonwoven fabrics is usually expressed in ounces of material per square yard (osy) or grams per square meter ($g/m^2$ or gsm) and the fiber diameters useful are usually expressed in microns. (Note that to convert from osy to gsm, multiply osy by 33.91).

As used herein, the term "spunbond", "spunbonded", and "spunbonded filaments" refers to small diameter continuous filaments which are formed by extruding a molten thermoplastic material as filaments from a plurality of fine, usually circular, capillaries of a spinnerette with the diameter of the extruded filaments then being rapidly reduced as by, for example, eductive drawing and/or other well-known spunbonding mechanisms. The production of spunbonded nonwoven webs is illustrated in patents such as, for example, in U.S. Pat. No. 4,340,563 to Appel et al., and U.S. Pat. No. 3,692,618 to Dorschner et al. The disclosures of these patents are hereby incorporated by reference.

As used herein the term "meltblown" means fibers formed by extruding a molten thermoplastic material through a plurality of fine, usually circular die capillaries as molten threads or filaments into converging high velocity gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, in various patents and publications, including NRL Report 4364, "Manufacture of Super-Fine Organic Fibers" by B. A. Wendt, E. L. Boone and D. D. Fluharty; NRL Report 5265, "An Improved Device For The Formation of Super-Fine Thermoplastic Fibers" by K. D. Lawrence, R. T. Lukas, J. A. Young; and U.S. Pat. No. 3,849,241, issued Nov. 19, 1974, to Butin, et al.

As used herein "multilayer laminate" means a laminate wherein one or more of the layers may be spunbond and/or meltblown such as a spunbond/meltblown/spunbond (SMS) laminate and others as disclosed in U.S. Pat. No. 4,041,203 to Brock et al., U.S. Pat. No. 5,169,706 to Collier, et al, U.S. Pat. No. 5,145,727 to Potts et al., U.S. Pat. No. 5,178,931 to Perkins et al. and U.S. Pat. No. 5,188,885 to Timmons et al. Such a laminate may be made by sequentially depositing onto a moving forming belt first a spunbond fabric layer, then a meltblown fabric layer and last another spunbond layer and then bonding the laminate in a manner described below. Alternatively, the fabric layers may be made individually, collected in rolls, and combined in a separate bonding step. Such fabrics usually have a basis weight of from about 0.1 to 12 osy (6 to 400 gsm), or more particularly from about 0.40 to about 3 osy. Multilayer laminates for many applications also have one or more film layers which may take many different configurations and may include other materials like foams, tissues, woven or knitted webs and the like.

These terms may be defined with additional language in the remaining portions of the specification.

SUMMARY OF THE INVENTION

In light of the problems and issues discussed above, it is desired to have a reversible mop head having more than a single substrate support surface to allow for longer use before changing the cleaning substrate. It is further desired the area of unused cleaning substrate be minimized and the usage of the entire cleaning substrate be maximized. Finally, it is desired that such a mop head be easy to control in use.

The present invention is directed to a reversible mop head assembly for use with a mop handle. The mop head assembly includes a transverse support shaft, a pair of end caps positioned at opposite ends of the transverse support shaft, a pair of opposed substrate support surfaces positioned between and supported by the end caps, and a head mount coupled to the transverse support shaft centrally between the end caps.

In some embodiments, the pair of end caps may be a moveable end cap and a fixed end cap. In such embodiments the moveable end cap is configured to be disengaged from the substrate support surfaces such that a sleeve substrate may be positioned over the substrate support surfaces. In further embodiments, the moveable end cap may have finger hold or a grip that aids the user in disengaging the moveable end cap from the substrate support surfaces.

In various embodiments of the assembly, the substrate support surfaces may include a fastener channel to receive and hold fastener strips, may include a curved lip on either the front and/or back edges of the support surface, or may be convexly curved. In other embodiments, the mop head may include a pair of opposing wheels positioned on the central portion of the transverse support shaft with each wheel positioned on opposite sides of the head mount. In some embodiments the head mount may also include a socket mount configured to releaseably couple to a mop handle and such a socket mount may additionally be threaded.

The invention is also directed to a reversible mop system including the reversible mop head, a mop handle and a singular cleaning substrate positioned over the substrate support surfaces of the reversible mop head. The mop handle may be a quick-release handle including a proximal end proximate to the mop head and a distal end distal to the mop head; a quick-release coupling assembly positioned on the proximate end of the handle, the quick-release coupling assembly configured to releaseably couple the handle to the head mount; and a button actuator positioned on the distal end of the handle, the button actuator operably connected to the quick-release coupling assembly. Additionally, in various embodiments, the handle may additionally include a coupler shroud that cooperatively couples with the head mount, the button actuator may be recessed within the end of the shaft, and the handle may include an ergonomic, freely-rotating knob.

In some embodiments, the system may include a continuous web of cleaning substrate, the continuous web having lines of weakness at regular intervals such that various widths of cleaning substrate are removable via the lines of weakness. Such a system may additionally include a container in which the continuous web of cleaning substrate may be contained and from which the substrate may be dispensed. Additionally, such a container may include a separator that assists in separating individual cleaning substrates from the continuous web of cleaning substrate.

BRIEF DESCRIPTION OF THE DRAWINGS

FIG. 4 is a partial perspective view of a fastener channel including a fastener strip associated with the substrate support surface;

FIG. 5 is a perspective view of a fixed end cap of the mop head of FIG. 1;

FIG. 6A is a perspective view of a rounded end plate which may be used with the fixed end cap of FIG. 5;

FIG. 6B is a perspective view of a brush end plate which may be used with the fixed end cap of FIG. 5;

FIG. 6C is a perspective view of a scrubber end plate which may be used with the fixed end cap of FIG. 5;

DETAILED DESCRIPTION

Figure 1:
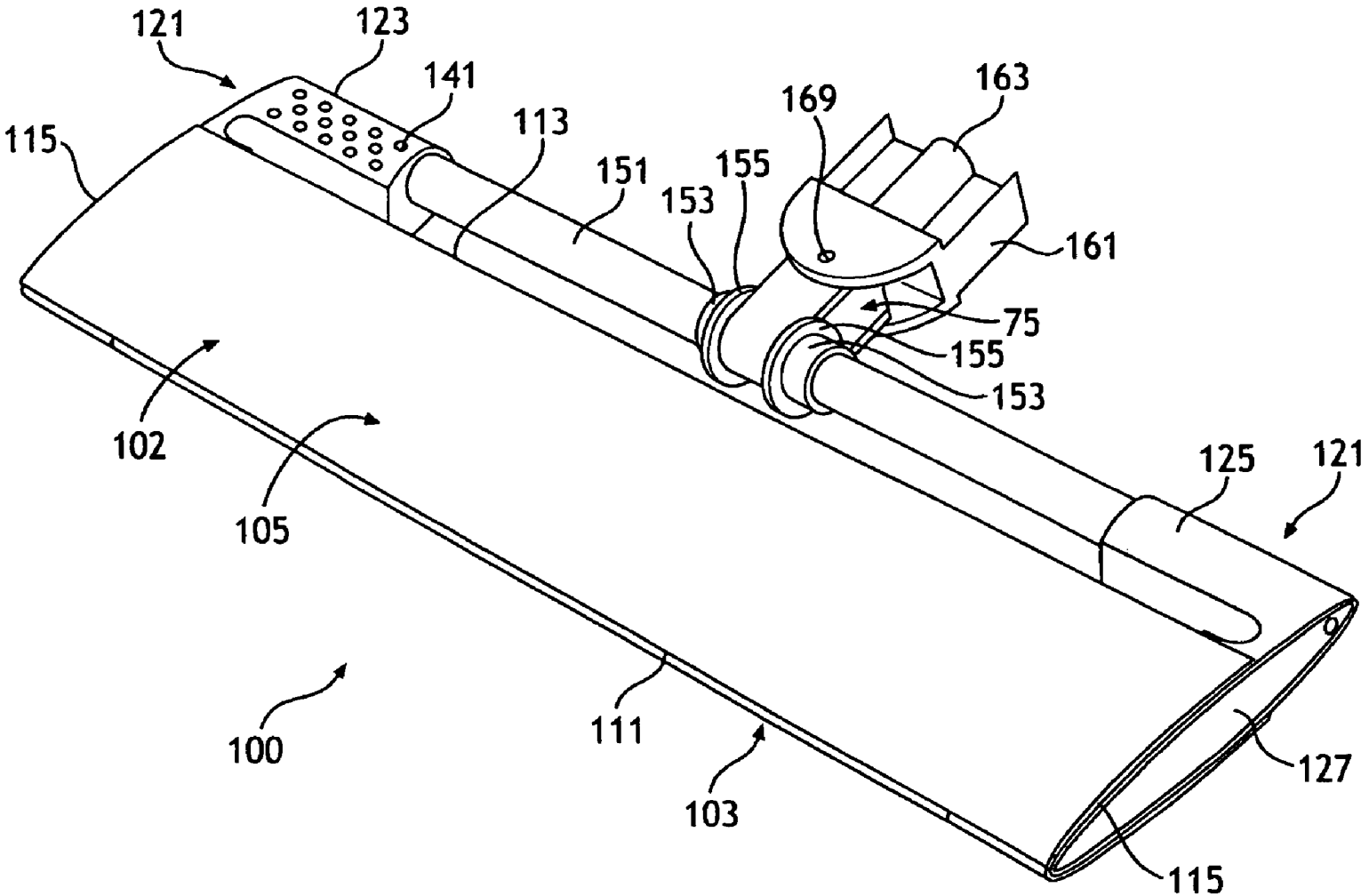
FIG. 1 is a perspective view of a reversible mop head of the present invention.

Reference will now be made in detail to one or more embodiments of the invention, examples of which are illustrated in the drawings. Each example and embodiment is provided by way of explanation of the invention, and is not meant as a limitation of the invention. For example, features illustrated or described as part of one embodiment may be used with another embodiment to yield still a further embodiment. It is intended that the invention include these and other modifications and variations as coming within the scope and spirit of the invention.

Referring to FIGS. 1-9 in general, the mop head 100 of the present invention includes a transverse support shaft 151 having a pair of end caps 121 at opposite ends of the transverse support shaft 151. A pair of opposed substrate support surfaces 102 are positioned between, and supported by, the end caps 121. A head mount 161 is coupled to the transverse support shaft 151 at a central position on the transverse support shaft 151 between the end caps 121. The head mount 161 is configured to releaseably couple the mop head 100 with a handle.

In use, a disposable cleaning substrate may be positioned upon the substrate support surface 102 and either side of the mop head 100 may be used to clean a floor (or other surface); when the substrate on floor-facing side of the mop head 100 becomes soiled, the mop head 100 may be flipped over such that the unused cleaning substrate surface becomes the floor-facing side of the mop head 100.

The cleaning substrate is supported upon a lower substrate support surface 103 and an upper substrate support surface 105. Both of these substrate support surfaces are preferably similar in size and shape. The terms "lower" and "upper" are used here to differentiate between the two substrate support surfaces for the sake of clarity in describing the mop head 100 as illustrated in FIG.ures. These terms and are not intended to be limiting as to in-use position of the substrate support surfaces; in use, the lower substrate support surface 103 may be facing the floor to be cleaned (as shown in FIG. 1) and then the mop head 100 may be flipped over such that the upper substrate support surface 105 is then facing the floor to be cleaned.

Figure 2:
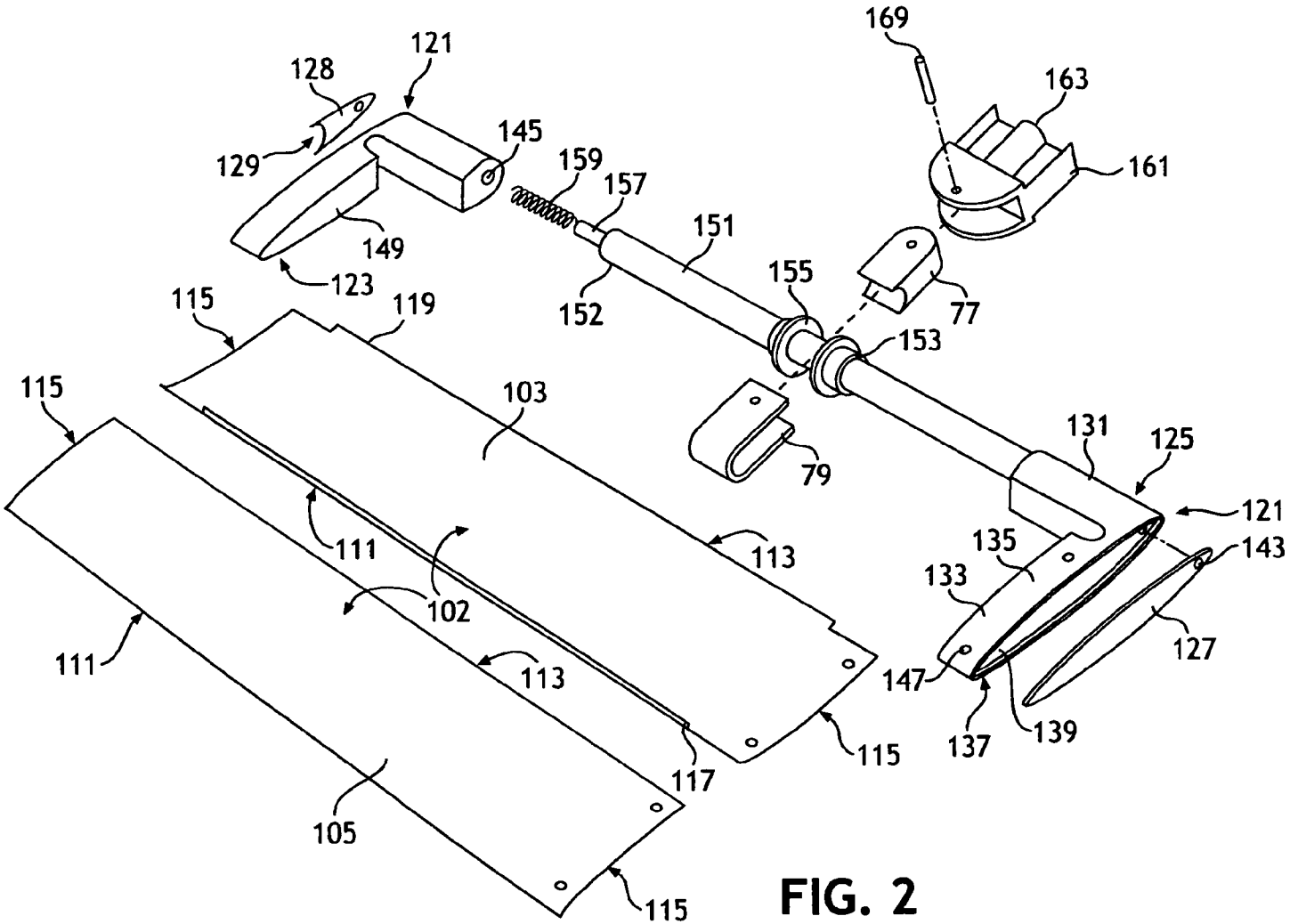
FIG. 2 is an exploded perspective view the reversible mop head of FIG. 1.

As shown in FIGS. 1 and 2, the mop head 100 is generally rectangular with a side-to-side width (the distance between the end edges 115 of the substrate support surfaces 102) greater than its front-to-back depth (the distance between the front edge 111 of the substrate support surfaces 102 and the transverse support shaft 151). However, the mop head 100 may be any size and shape, symmetrical or asymmetrical that is desired for the particular cleaning needs being addressed. Generally, the mop head 100 may have a side-to-side width of between about 10 inches (254 mm) and about 72 inches (1.8 m) and a front-to-back depth of between about 4 inches (102 mm) and about 16 inches (406 mm), though other sizes are possible. By way of non-limiting example, a mop head 100 intended for commercial use may have a width of about 48 inches (1.2 m) and a depth of about 12 inches (305 mm), while a mop head 100 intended for domestic use may have a width of about 10 inches (254 mm) and a depth of about 6 inches (152 mm). The dimensions of the mop head 100 may be any width and depth that is desired to meet the particular cleaning application.

The thickness of the mop head 100 is primarily the thickness of the end caps 121 plus the thickness of the substrate support surfaces 102 supported upon the end caps 121. Both of the substrate support surfaces 102 and the end caps 121 are slightly convexly curved between the front edges 111 and the back edges 113 of the substrate support surfaces 102. Resultantly, the cross-sectional profile of the mop head 100 is generally oblate in shape, however other shapes, symmetrical and asymmetrical, are possible. Additionally, the thickness at the back of the mop head 100 (proximate to the transverse support shaft) will be the thickness of the shoulder 131 of the end caps 121.

Thus, the thickness of the mop head 100 may vary between the front and back of the mop head 100. Generally, the mop head 100 may have a thickness between about 0.25 inches (6.4 mm) and about 1-inch (25.4 mm) at the front edge 111, between about 1-inch (25.4 mm) and about 2 inches (50.8 mm) in the center, and between about 0.75 inches (19.1 mm) and about 1.5 inches (38.1 mm) at the back, though other sizes and cross-sectional profiles are possible.

The transverse support shaft 151 spans the side-to-side width of the mop head 100 and acts as the spine on which the mop head 100 is supported; the support shaft 151 brings all the elements of the mop into cooperation. The end caps 121 are coupled to either end of the support shaft 151, with the arms 133 of the end caps 121 extending forward of the support shaft 151. The substrate support surfaces 102, on which the cleaning substrate is to be supported, are themselves supported by the arms 133 of the end caps 121. The head mount 161 is coupled to the support shaft 151 and centered between the end caps 121.

As shown in FIGS. 1 and 2, a pair of stop collars 153 may be used to keep the head mount 161 properly positioned relative to the support shaft 151. Additionally, a pair of wheels 155 may also be included on the transverse support shaft 151. As shown in FIGS. 1 and 2, the wheels 155 may be positioned between the head mount 161 and the stop collars 153. During use, such wheels 155 may be included to help move the mop head 100 and keep the head mount 161 from rubbing on the surface to be cleaned.

In use, a handle 10 (see FIG. 7) is coupled with the head mount 161. When the user pushes on the handle 10 to clean a surface with the attached mop head 100, the forces applied to the handle 10 are communicated through the head mount 161, through the transverse support shaft 151, and to both of the end caps 121. By translating the forces applied the centrally located handle 10 to the end caps 121 of the mop head 100, the user is given a greater degree of control of the mop head 100 than if the handle was directly connected to the center of the mop head 100. By effectively controlling the mop head 100 from its ends, the user may easily turn the mop head 100 and maintain a desired angle of the front edge of the mop head 100 relative to the direction the mop head 100 is being pushed or pulled. Such ease of control relative to a handle mounted on the centroid of the mop head is magnified as the size of the mop head 100 is increased.

The transverse support shaft 151 is hollow to accommodate the end caps 121. The hollowed nature of the support shaft 151 also decreases the weight of the mop head 100 and the amount of material used in making the support shaft 151. The thickness of the hollow transverse support shaft 151 is a function of the materials used to make the support shaft 151, the inside diameter required to accommodate the elements to be accommodated within the support shaft 151, and the strength and weight desired. One skilled in the art would see how such variables could be balanced to produce the transverse support shaft 151.

The transverse support shaft 151 may be made from any material that meets the needs of the particular mop head 100. For example, a stronger transverse support shaft 151 may be desired for commercial applications while a lighter shaft may be desired for home applications. Other considerations may include, but are not limited to, weight, durability, compatibility with chemicals and substances the handle may come in contact, appearance, ease of cleaning, colors available, disposability, and the like. Typically, the support shaft 151 may be made of a metal, plastic, or wood. More particularly, the support shaft 151 may be made of aluminum, stainless steel, ABS-plastic, or the like. Again, one skilled in the art would see how such variables could be balanced to produce the transverse support shaft 151.

As seen in FIGS. 1 and 2, the end caps 121 are coupled to opposite ends of the transverse support shaft 151. Each end cap 121 has a shoulder 131 and an arm 133. The shoulder 131 of the end cap 121 is generally coaxial with the support shaft 151 and is configured to couple with the support shaft 151. The coupling of the shoulder 131 to the support shaft 151 may be accomplished by any method or fastener as are known by those skilled in the art. By way of non-limiting examples, the support shaft 151 may be coupled to the end cap 121 by an adhesive, a screw, a bayonet mount, a threaded mount, a friction fitting, or other similar fixture or fastener.

Figure 3:
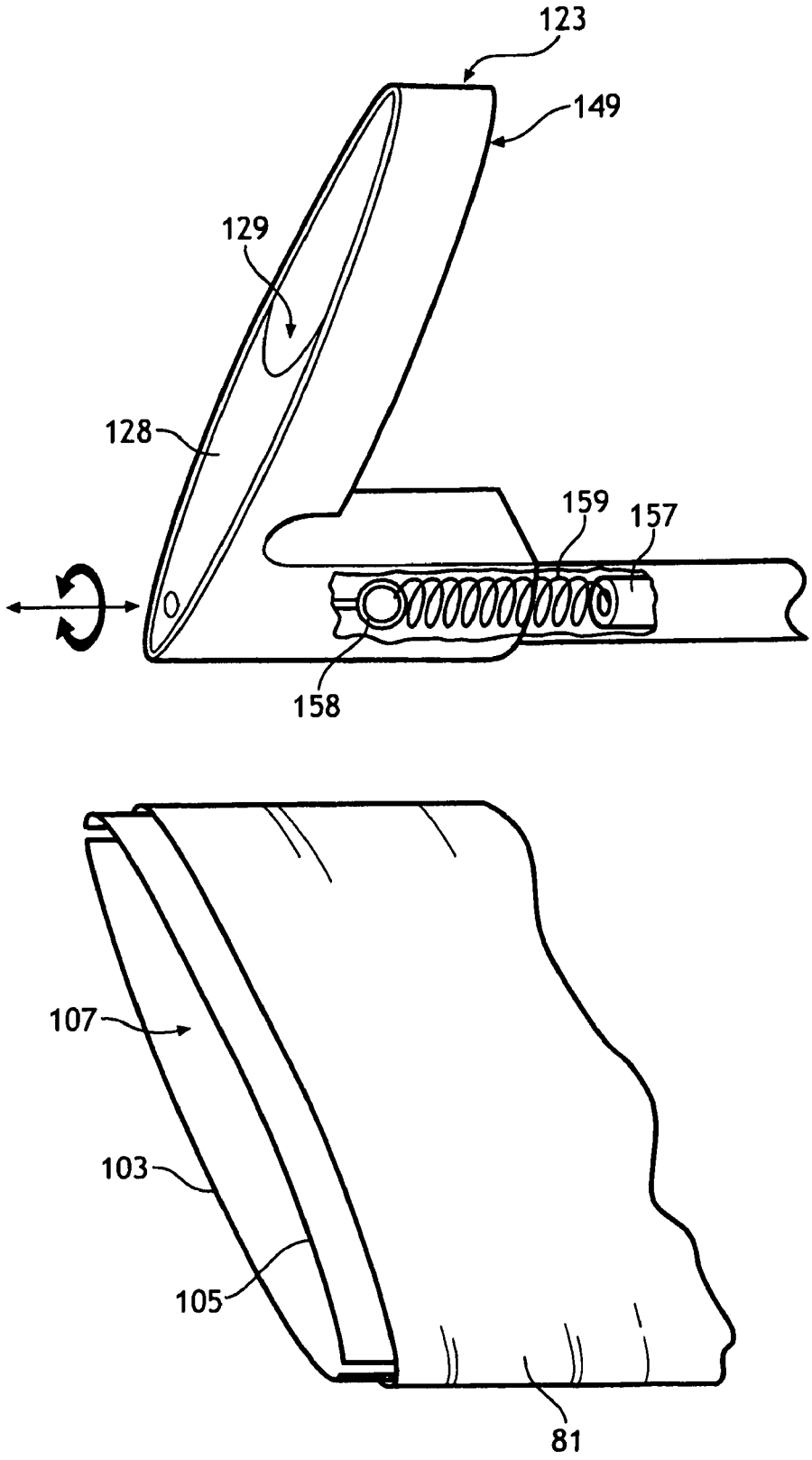
FIG. 3 is a partial perspective view of the moveable end cap of the reversibly mop head of FIG. 1, shown disengaged from the upper and lower substrate support surfaces, a sleeve substrate in position over the upper and lower substrate support surfaces, with cutaway in the end of the transverse support shaft to illustrate the connection of the moveable end cap to the transverse support shaft.

As seen in the mop head 100 shown FIG. 2, and in the cutout of FIG. 3, the end cap 121 may couple with the support shaft 151 by a shaft socket 145 present within the shoulder 131 of the end cap 121. The support shaft 151 may include a retention rod 157 inside its hollow interior, the retention rod 157 extending between the pair of end caps 121. As seen in the cutout in FIG. 3, one end of a tension spring 159 is anchored into the end of the retention rod 157 with the other end of the tension spring 159 attached to an eye bolt 158 within the interior of the shaft socket 145 of the end cap 121. As shown in FIG. 3, this particular coupling allows for this particular end cap 121 to function as a moveable end cap 123; the moveable end cap 123 permitted by the tension spring 159 to move back and forth along the axis of the support shaft 151 as well as rotate about the same support shaft 151 axis.

The opposed end cap 121 to such a moveable end cap 123 may be another moveable end cap 123, similarly coupled to the opposite end of the retention rod 157. Alternatively, as shown in FIGS. 1 and 2, the opposed end cap 121 may be a fixed end cap 125 into which the transverse support shaft 151 and the retention rod 157 are anchored with an end cap attachment 143.

A fixed end cap 125, as shown in FIGS. 2 and 5, may include an end plate 127 that fits within an end recess 139 of the end cap 121. Such an end plate 127 may be a flat plate as shown in FIG. 2 or may provide additional functionality to the mop head 100. As shown in FIGS. 5, 6A, 6B and 6C, various shapes, tools or other items may be configured to fit within the end recess 139 of a fixed end cap 125. In the example of FIG. 6A, the end cap 125 may include a rounded end cap 191 that could help prevent the mop head 100 from scraping wall or other surfaces while in use. In the example of FIG. 6B, the end cap 125 may include a brush end cap 193. In the example of FIG. 6C, the fixed end cap 125 may include a scrubbing edged end cap 195 having ridges made of a scrubbing material (e.g., rubber, plastic, sponge). Such examples are not intended to be limiting; one skilled in the art could see how other items could be incorporated into an end cap 121 to add functionality to the mop head 100.

The arms 133 of the end caps 121 extend from the shoulder 131 of the end cap 121 and forward of the transverse support shaft 151. Opposite faces of the arm 133 include surfaces upon which the substrate support surfaces 102 are supported. As shown in FIG. 2, the arm 133 may include an upper surface 135 upon which the upper substrate support surface 105 may be supported, and a lower surface 137 upon which the lower substrate support surface 103 may be supported. The terms "lower" and "upper" are used here to differentiate between the two surfaces of the arm 133 for the sake of clarity; these terms and are not intended to be limiting as to in-use position of the surfaces.

The substrate support surfaces 102 are included in the mop head 100 to provide support to a cleaning substrate placed upon the substrate support surfaces 102 during use of the mop head 100. In general, the substrate support surfaces 102 are singular, convexly-curved surfaces that are supported by, and between, the end caps 121. Each substrate support surface 102 has a pair of opposed end edges 115 that extend along the front-to-back depth of the mop head 100. Additionally, the substrate support surfaces 102 have a back edge 113 and a front edge 111, where both edges extend along the side-to-side width of the mop head 100; the back edge 113 being proximate to the transverse support shaft 151.

In assembling the mop head 100, as shown in FIGS. 1 and 2, the substrate support surfaces 102 are coupled to at least one of the end caps 121 with substrate support surfaces opposed to each another. The front edges 111 of each surface proximate to each other and the back edges 113 similarly proximate to each other and configured such that the surfaces 102 are convexly curved outwardly and defining an interior space 107 between the surfaces 102 (see FIG. 3).

The substrate support surfaces 102 may be made from any material that meets the needs of the particular mop head 100. For example, a substrate support surface 102 may be desired for commercial applications may utilize a heavier and/or stronger material, while a lighter material may be desired for home applications. Other considerations may include, but are not limited to, weight, durability, compatibility with the cleaning substrate(s) to be used, compatibility with chemicals and substances the surfaces 102 may come in contact, appearance, ease of cleaning, colors available, disposability, and the like. Typically, the substrate support surface 102 may be made of a metal or plastic. More particularly, the substrate support surfaces 102 may be made of aluminum, stainless steel, ABS-plastic, or the like. Again, one skilled in the art would see how such variables could be balanced to produce the substrate support surfaces 102.

The lower substrate support surface 103 and the upper substrate support surface 105 are illustrated in FIGS. 1, 2 and 3 as separate surfaces. Such a design maximizes support of the substrate in areas that the substrate will be effective used to clean a surface, while minimizing the materials used in the mop head 100 in consideration of weight and cost of materials. However, designs were the substrate support surfaces 102 are opposite sides of a solid central portion, or a continuous surface that forms an oblate tube between the end caps 12, are also considered within the scope of the present invention.

For the mop head 100 illustrated in FIGS. 1 and 2, the lower substrate support surface 103 is attached to the lower surface 137 of the fixed end cap 125. Similarly, the upper substrate support surface 105 is attached to the upper surface 135 of the fixed end cap 125. These substrate support surfaces 102 are attached to the arm 133 of the fixed end cap 125 by a surface attachment 147. The surface attachment 147 may be any type of fastener capable of coupling the substrate support surface 102 to the fixed end cap 125. By way of non-limiting example, the surface attachment 147 may be a rivet, a screw, a bolt, a magnet, an adhesive, or some other similar fastener.

Additionally, the substrate support surfaces 102 may include a front lip 117 along the front edge 111 and a back lip 119 along the back edge 113 of one or both of the substrate support surfaces 102. Lips 117, 119 on the front or back edges 111, 113 of the substrate support surfaces 102 may help protect a cleaning substrate present positioned upon the substrate support surfaces 102. When the substrate support surface 102 ends abruptly at the front edge 111 or back edge 113, a cleaning substrate that is held over such an edge may tear against the edge during use. For example, by providing a front lips 117 on the substrate support surfaces 102, a cleaning substrate held in place over the leading edge of the mop head 100 will help support the substrate in pushing around dirt and debris and decrease any tendency for the substrate to be torn by the front edges 111 of the substrate support surfaces 102.

As discussed above, the substrate support surfaces 102 and the end caps 121, on which the substrate support surfaces 102 are supported, are convexly curved from the front edge 111 to the back edge 113. Traditional dry dust mops, disposable cleaning substrate mops, and sponge mops typically have a flat surface that contacts the surface to be cleaned (i.e., a floor). Such a flat-contacting surface maximizes the contact of the mop head or substrate with the floor, however, dust, dirt and debris tends to pile up at the edges of such mops, leaving the central portion of the mop or substrate unused. By providing a slight convex curve to the substrate support surfaces 102 of the present invention, a greater percentage of the entire cleaning substrate surface may be used.

The mop head 100 of the present invention is intended to be used with a disposable cleaning substrate. Such cleaning substrates are widely available and well understood. Typically such substrates may be woven, nonwoven, laminates, composites, or combinations thereof, and may be made from natural fibers, synthetic fibers, or combinations thereof. By way of non-limiting examples, the disposable cleaning substrate may be a spunbonded polypropylene material, a knitted polyester substrate, a microfiber substrate made with a polyester/polyamide yarn, a stabilized open-cell thermoplastic foam laminate, a hydroentangled nonwoven composite material, a sponge substrate, or other such substrates as may be desired for particular cleaning needs.

Additionally, such cleaning substrates may be provided as a dry substrate or as a saturated substrate. The cleaning substrate may include additional substances such as cleansers, disinfectants, sanitizers, fragrances, or the like. The disposable cleaning substrate may also be electric treated to impart a static electric charge to the material to attract dust to the charged substrate. Similarly, the disposable cleaning substrate may be made from particular materials (such as rubber, spunbonded polypropylene, spunlace fabrics, or combinations thereof) that may develop such a static electric charge during it use on particular surfaces.

As shown in FIG. 3, the disposable cleaning substrate may be a sleeve substrate 81; a loop, or tube, of material having two open ends. It is desirable that a sleeve substrate 81 have a width (between its two open ends) comparable to the side-to-side width of the mop head 100 on which the substrate 81 is to be used. Such a sleeve substrate 81 is positioned on the substrate support surfaces 102, by pulling the sleeve substrate 81 over the exposed end edges 115 of the upper and lower substrate support surfaces 105,103. It is also desired that the sleeve substrate 81 be sized appropriately so the sleeve substrate 81 fits snuggly over the substrate support surfaces 102 when positioned upon such surfaces 102.

For the mop head 100 illustrated in FIGS. 2 and 3, the end cap 121 prevents such a sleeve substrate 81 from being positioned over the substrate support surfaces. Thus a moveable end cap 123 is required to use a sleeve substrate. The moveable end cap 123 illustrated in FIGS. 2 and 3, and as discussed above, is coupled to the transverse support shaft 151 in such way that the moveable end cap 123 may move back and forth along the support shaft 151 and rotate about the support shaft 151. Thus, to position a sleeve substrate 81 on the mop head 100, the moveable end cap 123 may be pulled out from the interior space 107 between end edges 115 of the substrate support surfaces 102 and then rotated about the transverse support shaft 151 axis. Resultantly, the ends 115 of the substrate support surfaces 102 are exposed such that the sleeve substrate 81 may be positioned on the surfaces 102. When the sleeve substrate 81 is properly positioned on the substrate support surfaces, the moveable end cap 123 may be rotated back into proper position and allowed to be reinserted into the interior area 107 between the substrate support surfaces 102.

To facilitate the ease in manipulating the moveable end cap 123 additional features may be added to the end cap 123. For example, the design of the arm 133 of the moveable end cap 123 may be shaped to include a wedge 149, tapered down from the support surfaces of the arm 133; the wedge 149 facilitating the insertion of the moveable end cap 123 between the upper and lower substrate support surfaces 105, 103. Additionally, or alternatively, the moveable end cap 123 may include a finger hold 129 to help the user pull the moveable end cap 123 from the end of the mop head 100. Such a finger hold 129 may be a part of an end plate 128 attached to the end cap 123 or may be an integral part of the end cap 123 shape. Additionally, or alternatively, the moveable end cap 123 may include a shoulder grip 141 on the shoulder 131 of the end cap 123 to help the user pull the end cap 123 from the end of the mop head 100.

The disposable cleaning substrate may also be a singular sheet of material that is wrapped around the substrate support surfaces 102. It would be desired that such a substrate would have a width similar to mop head 100 width. It would also be desired that such a substrate would have a length that would allow the substrate to be wrapped from the back edge 113 of the lower substrate support surface 103, toward the front edges 111 of the lower and upper substrate support surfaces 103, 105, over the upper substrate support surface 105, and to the back edge 113 of the upper substrate support surface 105. The singular sheet cleaning substrate may be fastened to the substrate support surfaces 102 by clips, adhesives, or other similar fasteners, preferably positions proximate to the back edge(s) 113 of the substrate support surfaces 102.

FIG. 4 illustrates one potential fastener system that could be used with the substrate support surfaces 102 to secure the disposable cleaning substrate. A fastener channel 171 extending from the end edge 115 of the substrate support surface 102 may be included in the design of the substrate support surface. Such a fastener channel 171 may be configured to receive fastener strips 181 which could then secure the cleaning substrate to the substrate support surface 102. The fastener strip 181 shown in FIG. 4 includes a hook fastener 185 attached to a backing strip 183.

Although a hook fastener 185 is shown in FIG. 4, the fastener present on the fastener strip 181 may be any fastener attached to a backing strip 183 that is compatible with the particular substrate material to be affixed to the mop head 100. The fasteners may be appropriate to directly attach to the substrate material or they may cooperatively couple with a substrate fastener 93 (see FIG. 15) included on the cleaning substrate. Non-limiting examples of such fasteners that may be used with the fastener strips 181 may include independent fasteners such as hook fasteners, pressure-sensitive adhesives, and the like, as well as cooperative fasteners such as hook-and-loop fasteners, snaps, magnets, buttons, and the like.

The mop head 100 of the present invention may be included as part of a mop system that also includes a handle configured to be coupled to the head mount 161. Such a handle may be a traditional mop stick, as are well known, having a conventional threaded tip that screws into the head mount 161 or some other similar common coupling mechanism. However, it is preferred that the handle of the mop system be a quick-release handle 10 that allows the user to disengage the handle 10 from the mop head 100 without having to bend over, reposition the mop, or otherwise come in close contact with the potentially dirty mop head 100.

Referring to FIGS. 7 to 13 in general, such a quick-release handle 10 may include an elongated shaft 12 having two opposite ends; a proximal end 16 and a distal end 18. The proximal end 16 is proximate to the mop head 100 to which the handle 10 is to be attached. The distal end 18 is distal to the proximal end 16 and proximate to the user. The proximal end 16 includes the quick-release coupling assembly 20 that will cooperate with and couple the handle 10 to a mop head 100. The proximal end 16 is also considered as the attachment end of the handle 10 and the terms "proximal end" and "attachment end may be used interchangeably.

Generally, the distal end 18 will have a grip 41 by which the user may grasp the handle 10. The distal end 18 is also considered the grip end of the handle 10 and the terms "distal end" and "grip end" may be used interchangeably. Additionally, the distal end 18 accommodates the button actuator 45 which the user depresses to release the coupling assembly 20 from any mop head 100 that may be coupled with the proximal end 16 of the handle 10. Thus, the user can release a mop head 100 from the handle 10 by manipulating the distal end 18 rather than repositioning the handle, bending over, or going anywhere near the potentially dirty proximal end 16 of the tool.

Figure 9:
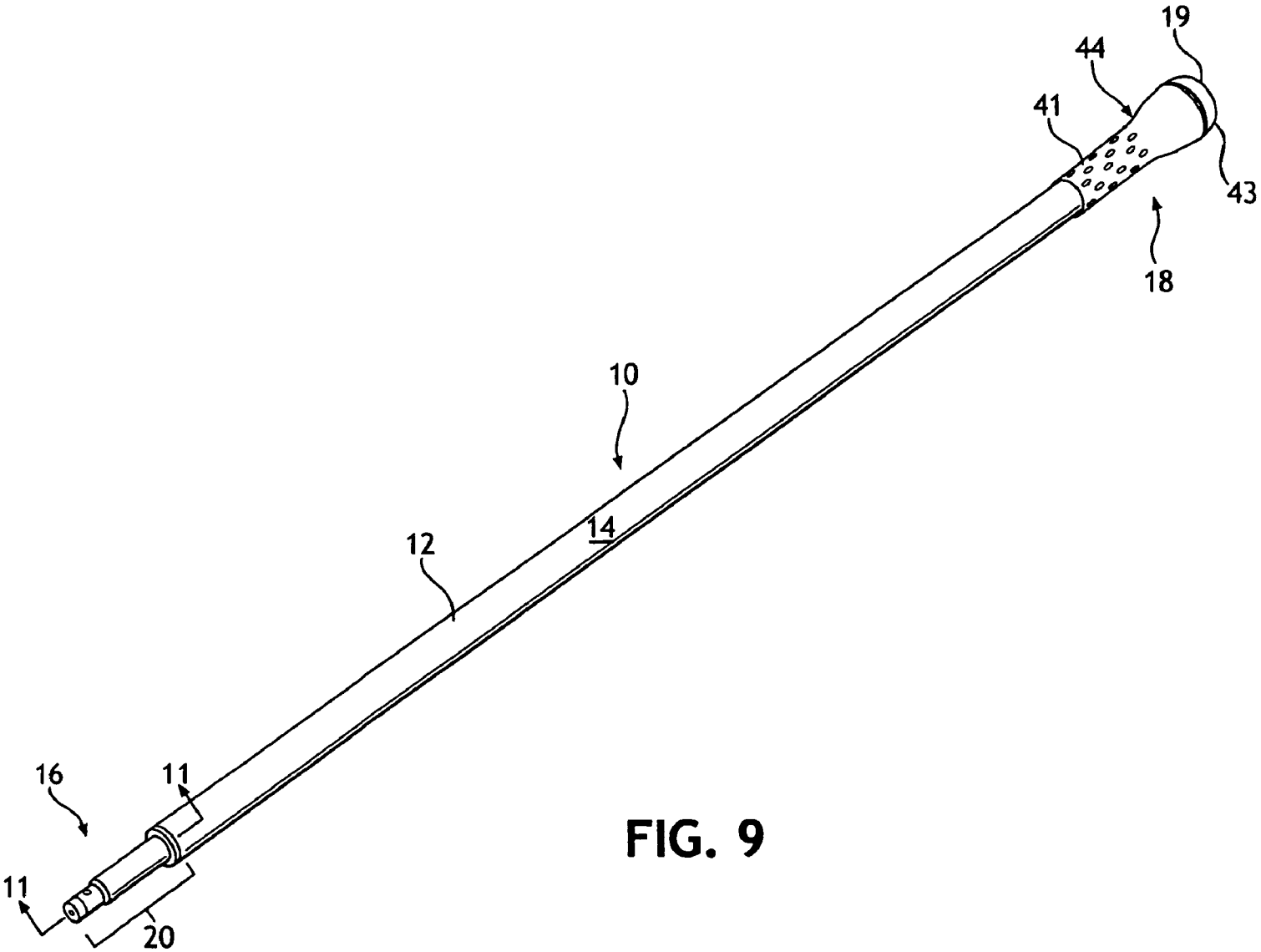
FIG. 9 is a perspective view of the quick-release handle.

The elongated shaft 12 is shown in FIG. 9 as generally cylindrical in shape, having a circular cross-section, as is common for most commonly available long tool handles. As such, the elongated shaft 12 has a single peripheral surface 14. However, other cross-sectional shapes are contemplated and are considered within the scope of the present invention. By way of non-limiting examples, the cross-sectional shape of the elongated shaft 12 may be elliptical, polygonal, or any other symmetrical or asymmetrical shape. Any such alternative cross-sectional shape may provide the elongated shaft 12 with additional peripheral surfaces 14.

Generally, it is desired that the elongated shaft 12 have a length of about 36 inches (0.9 m) to about 72 inches (1.8 m). For a quick-release handle 10 for use with the mop head 100, the elongated shaft will preferably be about 5 feet (1.5 m) in length, similar to the length of commonly available tool handles. The elongated shaft 12 should have an outside diameter suitable for the intended mop heads 100 and that is comfortable for use by range of user hand sizes. Typically, the outside diameter will be in the range of about 0.5 inches (12.7 mm) to about 1.5 inches (38.1 mm). Preferably, the outside diameter of the shaft 12 will be similar to that of commonly available handles, 0.75 inches (19.1 mm). Also, the shaft 12 illustrated in FIG. 9 is generally uniform in its diameter from the proximal end 16 to the distal end 18. However, the shaft 12 may alternatively have a non-uniform diameter along its length and may have sections of uniform and non-uniform diameter along its length.

The elongated shaft 12 is hollow to accommodate the push rod 31 and the other associated elements of the button actuator 45 and quick-release coupling assembly 20. The hollowed nature of the shaft 12 also decreases the weight of the handle 10 and the amount of material used in making the handle 10. The thickness of the hollow elongated shaft 12 is a function of the materials used to make the shaft 12, the inside diameter required to accommodate the elements to be accommodated within the shaft 12, and the strength and weight desired. One skilled in the art would see how such variables could be balanced to produce the desired shaft 12.

The elongated shaft 12 may be made from any material that meets the needs of the various mop heads 100 with which such a handle 10 is expected to be used. For example, a stronger shaft 12 may be desired for commercial applications while a lighter shaft may be desired for home applications. Other considerations may include, but are not limited to, weight, durability, compatibility with chemicals and substances the handle may come in contact, appearance, ease of cleaning, colors available, disposability, and the like. Typically, the shaft 12 may be made of a metal, plastic, or wood. More particularly, the shaft 12 may be made of aluminum, stainless steel, ABS-plastic, or the like. Again, one skilled in the art would see how such variables could be balanced to produce the desired shaft 12.

Additionally, designs in which the shaft 12 is telescoping, collapsible, and/or foldable are also considered to be within the scope of the present invention.

As discussed above, the quick-release coupling assembly 20 is positioned on the proximal end 16 of the handle 10 and is configured to be coupled with a mop head 100. The coupling assembly 20 may utilize any releasable coupling mechanism, as are well known, to releaseably couple with a mop head 100. By way of non-limiting examples, such a releasable coupling mechanism may utilize a detent ball assembly (as illustrated in FIGS. 10, 11A and 11B), a collet, a chuck, a clamping spring, a bayonet mount, a barbed fastener, a ribbed shank clip fastener, or other such mechanisms or any combination thereof.

The mechanism of the coupling assembly 20 is actuated by the user pressing and releasing the button actuator 45 on the distal end 18 of the shaft 12. The button actuator 45 is operably connected with the coupling assembly 20 by the push rod 31 which extends along the length of the shaft 12, from the button actuator 45 to the coupling assembly 20. As can be seen in the example illustrated in FIGS. 10, 11A, 11B, 12A, 12B and 13, the button actuator 45 is the terminus of the push rod 31 on the distal end 18 of the handle 10. At the proximal end of the push rod 31, a stop collar 33 is fitted around and attached to push rod 31 by a pin 34. A spring 35 around the push rod 31 and compressed between the stop collar 33 and the end wall of the stepped tip 21 of the coupling assembly 20 keeps the push rod 31 biased toward the distal end 18.

Figure 10:
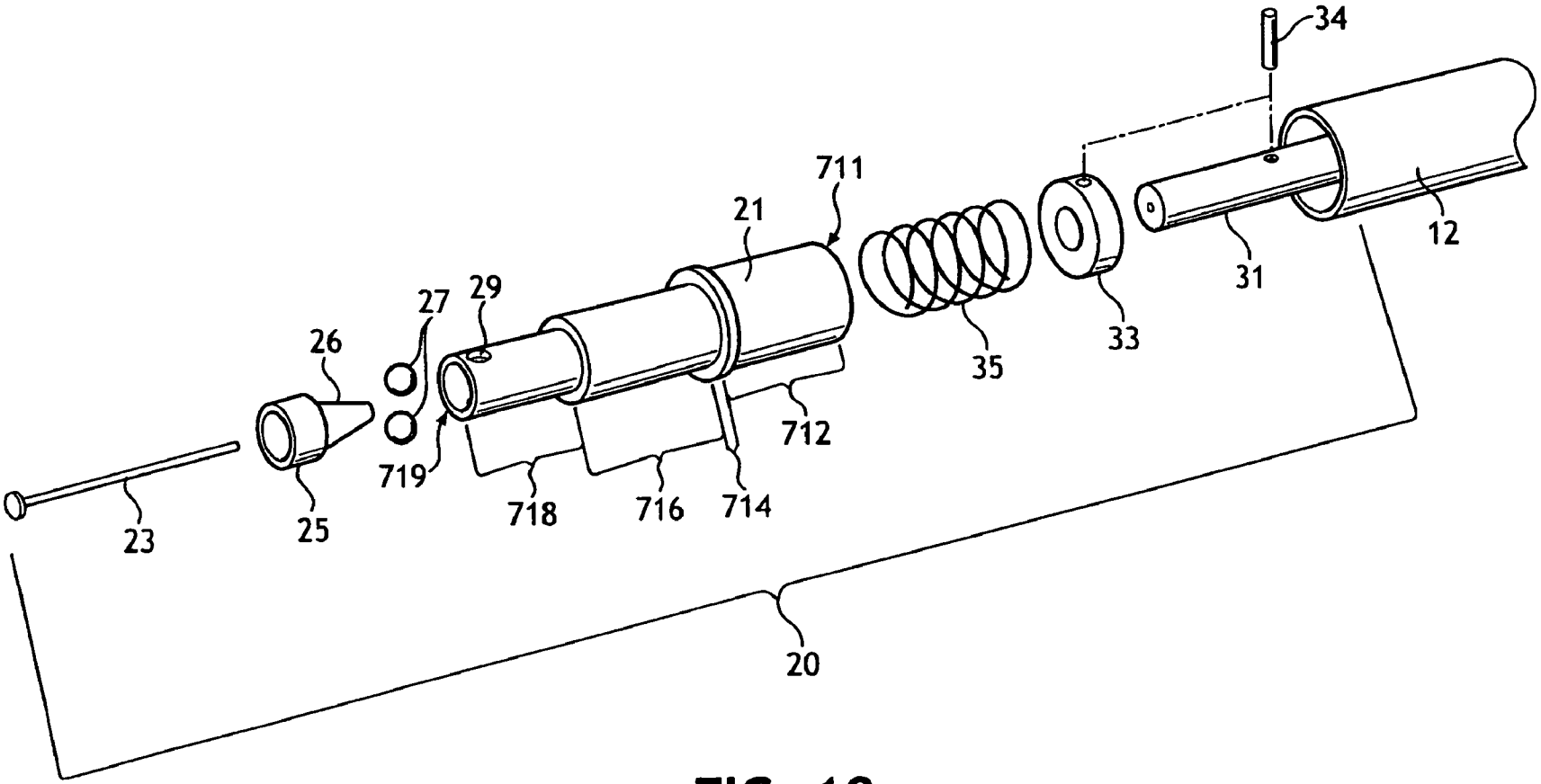
FIG. 10 is a partial perspective exploded view of a quick-release coupling assembly of the handle of FIG. 9.
Figure 11A:
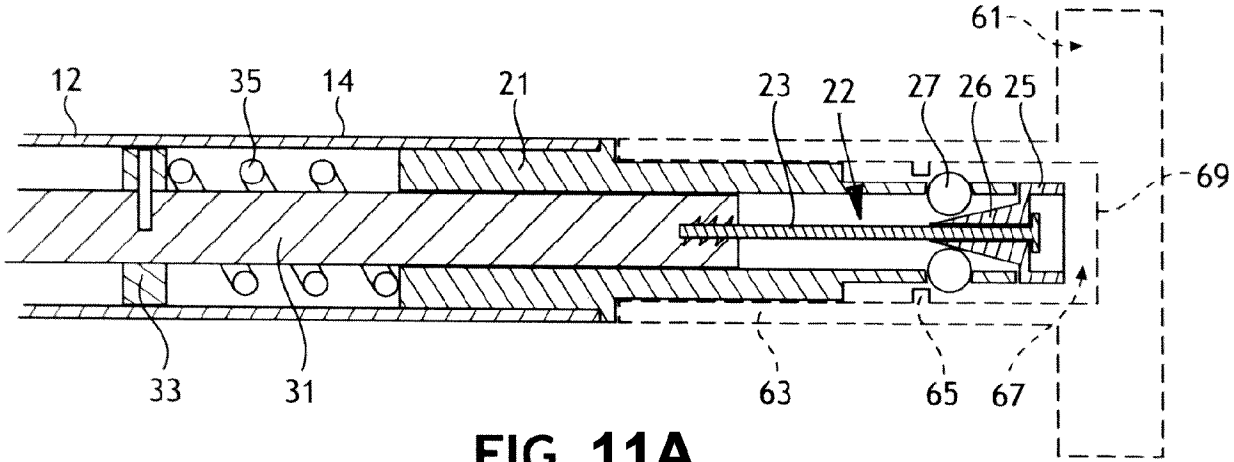
FIG. 11A is a cross-sectional view of a quick-release coupling assembly of the handle of FIG. 9 taken along line 11-11, shown in an engaged configuration with a generic socket mount (illustrated by phantom lines)
Figure 11B:
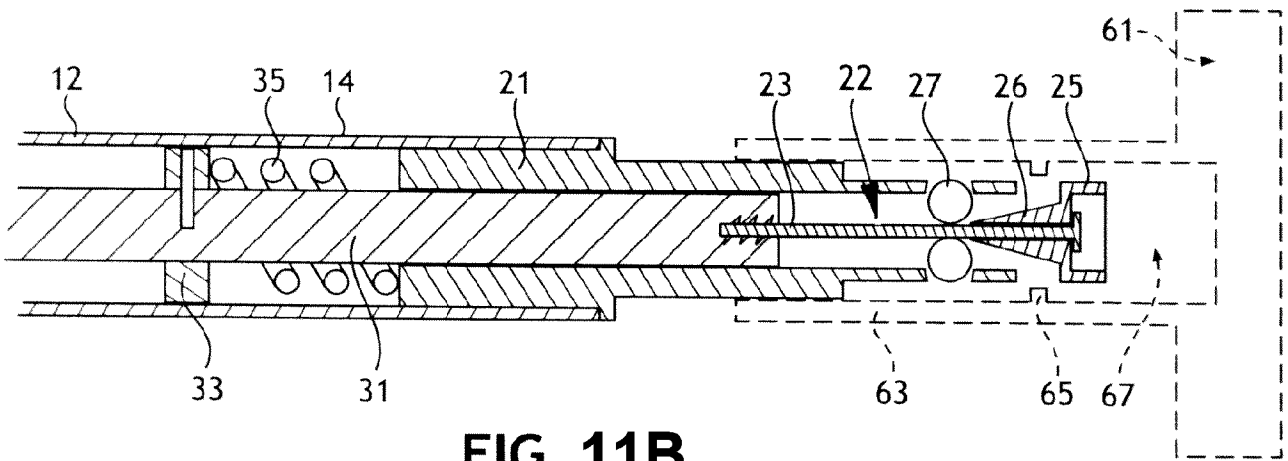
FIG. 11B is a cross-sectional view of the quick-release coupling assembly of the handle of FIG. 9 taken along line 11-11, shown in a release configuration in relation to the generic socket mount (illustrated by phantom lines)

As shown in FIGS. 10, 11A, and 11B, the coupling assembly 20 at the proximal end 16 of the shaft 12 includes a stepped tip 21 having a first end 711 inserted into the proximal end 16 of the shaft 12 and a second end 719 that extends from the end of the shaft 12 and into the socket mount 63 of a head mount 61 of a mop head 100 to which the handle 10 is to be coupled. The stepped tip 21 has an internal longitudinal channel 22 that extends the length of the stepped tip 21, from the first end 711 to the second end 719. The first section 712 of the stepped tip 21 near the first end 711 has a diameter slightly smaller than the inside diameter of the shaft 12 such that the stepped tip 21 may be snuggly fit into the proximal end 16 of the shaft 12. A lip section 714 of the stepped tip 21 seats the stepped tip 21 in the proximal end 16 of the shaft 12 and prevents the stepped tip 21 from being pushed further into the shaft 12.

As illustrated in FIGS. 11A and 11B, once the stepped tip 21 is installed in the shaft 12, the push rod 31 extends into the longitudinal channel 22 of the stepped tip 21. A stop rod 23 extends from the proximal end of the push rod 31 and is attached to the end of the push rod 31. The stop rod 23 extends out of the longitudinal channel 22 at the second end 719 of the stepped tip 21 and is capped by a head portion 25. The head portion 25 has a conical portion 26 that extends around the stop rod 23 inside the longitudinal channel 22. When the stop rod 23 is attached to both the push rod 31 and the head portion 25, the spring 35 that biases the push rod 31 toward the distal end 18 (as discussed above) also pulls the head portion 25 against the second end 719 of the stepped tip 21.

The third section 718 of the stepped tip 21 additionally includes ports 29 that extend from the longitudinal channel 22 to the outer surface of the stepped tip 21. A single detent ball 27 is retained by each port 29 and against the stop rod 23 or the conical portion 26.

When the handle 10 and coupling assembly 20 are in the engaged configuration, such as shown in FIG. 11A, the spring 35 between the stop collar 33 and the first end 711 of the stepped tip 21 biases the push rod 31 toward the distal end 18 of the shaft 12. The stop rod 23 attached to both the head portion 25 and the push rod 31 is subsequently pulled into contact with the second end 719 of the stepped tip 21. The head portion 25 is only pulled to the second end 719 and thus the spring 35 cannot push the push rod 31 further toward the distal end 18 or pull the stop rod further into the stepped tip 21. In such an engaged configuration, the coupling assembly 20 and push rod 31 are held in a neutral state by the spring 35.

As shown in FIG. 11A, when the coupling assembly 20 is in the engaged state, the head portion 25 is pulled to the second end 719 of the stepped tip 21 such that the conical portion 26 of the head 25 is pulled into the longitudinal channel 22. The conical portion 26 engages the detent balls 27 and pushes them into the ports 29 such that the detent balls partially extend outside of the exterior wall of the third section 718 of the stepped tip 21.

FIG. 11B illustrates the release configuration of the handle 10 and coupling assembly 20. When the user depresses the button actuator 45 at the distal end 18, the push rod 31 and the stop collar 33 is pushed toward the proximal end 16 of the shaft 12, compressing the spring 35 between the stop collar 33 and the first end 711 of the stepped tip 21. The stop rod 23, including the head 25, is consequently pushed away from the second end 719 of the stepped tip 21. As the conical portion 26 of the head 25 is pushed toward the second end 719, the detent balls 27 are allowed to fall back into the longitudinal channel 22 and against the stop rod 23. When the user releases the button actuator 45, the spring 35 returns the handle 10 to the engaged, or neutral, configuration as illustrated in FIG. 11A.

To work with the coupling assembly 20, the generic head mount 61 includes a socket mount 63 into which the coupling assembly 20 may be inserted. A retention stop 65 within the socket mount 63 cooperatively engages with the coupling assembly 20 to securely couple the working head and the quick-release handle 10. Such a retention stop 65 may be anything within the socket mount 63 that cooperatively engages the detent balls 27 of the coupling assembly 20. By way of non-limiting examples, the retention stop 65 may be a ring fixed within the socket mount 63 (as shown in FIGS. 11A and 11B), recesses within the wall of the socket mount 63, holes in the socket mount 63 (as shown in FIG. 9), or another configuration which can engage the detent balls 27.

In operation, when the coupling assembly 20 is inserted into the socket mount 63, the stepped tip 21 would proceed from the mouth of the socket recess 67 toward the recess terminus 69. When the coupling assembly 20 is in the engaged (neutral) configuration, the detent ball 27 are pushed out of the ports 29 by the conical portion 26 of the head 25, as discussed above. The inside diameter of the ring used as the retention stop 65 shown in FIGS. 11A and 11B is designed to be slightly larger than the outer diameter of the third portion 718 of the stepped tip 21. Thus, as the stepped tip 21 is inserted into the socket mount 63, the third portion 718 snugly passes into the retention stop 65, but the protruding detent balls 27 will come into contact with the retention stop 65. As the user continues to apply insertion pressure to the stepped tip 21, the detent balls 27 are forced into the ports 29 and push against the conical portion 26 and consequently push the head 25 from the second end 719. Once the stepped tip 21 is pushed farther into the socket mount 63, the detent balls 27 clear the retention stop 65 and are again forced out of the ports 29 by the conical portion 26. The detent balls 27 engage the retention stop 65 as illustrated in the engaged configuration shown in FIG. 11A.

The socket mount 63 includes a socket recess 67 on the recess terminus side of the retention stop 65. Such a recess 67 allows enough room for the head 25 to extend from stepped tip 21 as necessary for the detent balls 27 to drop inside the stepped tip 21 during insertion of the coupling assembly 20 or release of the working head, as discussed above.

The use of a coupling assembly 20 with the detent ball 27 mechanism described and illustrated in FIGS. 10, 11A and 11B, is only one possible coupling assembly 20 that may be used in the handle 10 of the present invention. As discussed above, other coupling mechanisms are contemplated for the coupling assembly 20 to couple the handle 10 with a mop head 100 and operably connect to the button actuator 45 such that the mop head 100 is released from the handle 10 when the button actuator 45 is manipulated.

For increased universality, the socket mount 63 may additionally be threaded from the mouth of the socket mount 63 to the retention stop 65. Such a socket mount 63 could then also accept a standard handle with a thread tip, if the user so desired.

The second section 716 of the stepped tip 21 is designed to have an outside diameter slightly smaller than the inside diameter of the socket mount 63. This ensures that the coupling assembly 20 snuggly fits within the socket mount 63 such that the mop head 100 is securely and solidly held at the end of the handle 10. If the socket mount 63 is threaded, the second section 716 would need to have an outside diameter slightly smaller that the threads.

Although not shown, a second spring could be included inside of the socket mount 63, attached to the recess terminus 69. Such a spring would be compressed upon insertion of the coupling assembly 20 into the socket mount 63. When the button actuator 45 was subsequently pressed to release the mop head 100 from the handle 10, such a spring would then bias the socket mount 63 off of the coupling assembly 20.

Additional stability may be added to the connection of the head mount 161 of the mop head 100 and the coupling assembly 20 by the inclusion of a coupler shroud 71 at the proximal end 16 of the shaft 12. As shown generally in FIGS. 7 and 8, the coupler shroud 71 has portions that both protect the exposed coupling assembly 20 from damage and cooperate with the designs of the head mounts 161 to securely couple the mop head 100 and handle 10.

Figure 7:
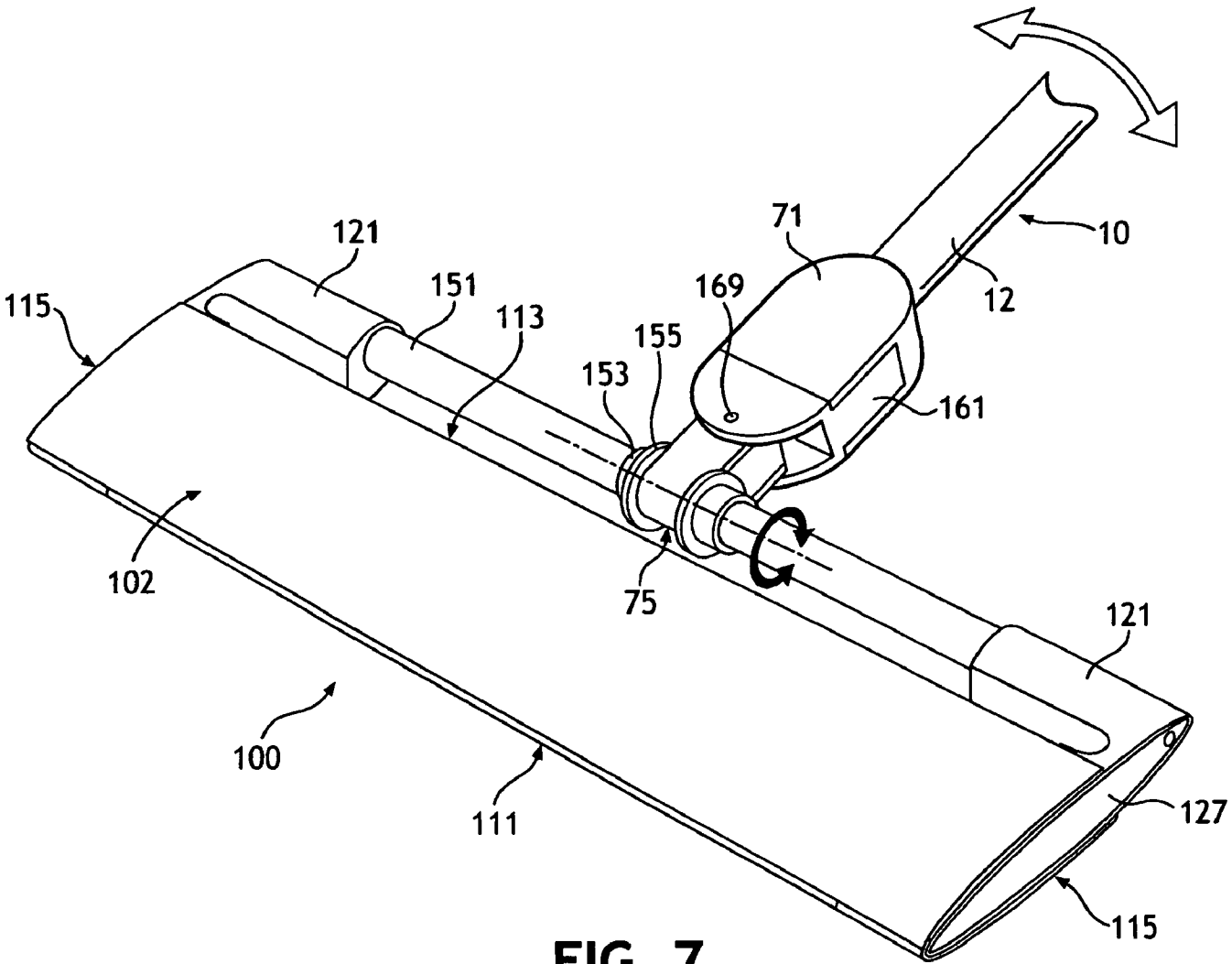
FIG. 7 is a partial perspective view of the reversible mop head of FIG. 1 shown coupled with a quick-release handle.
Figure 8:
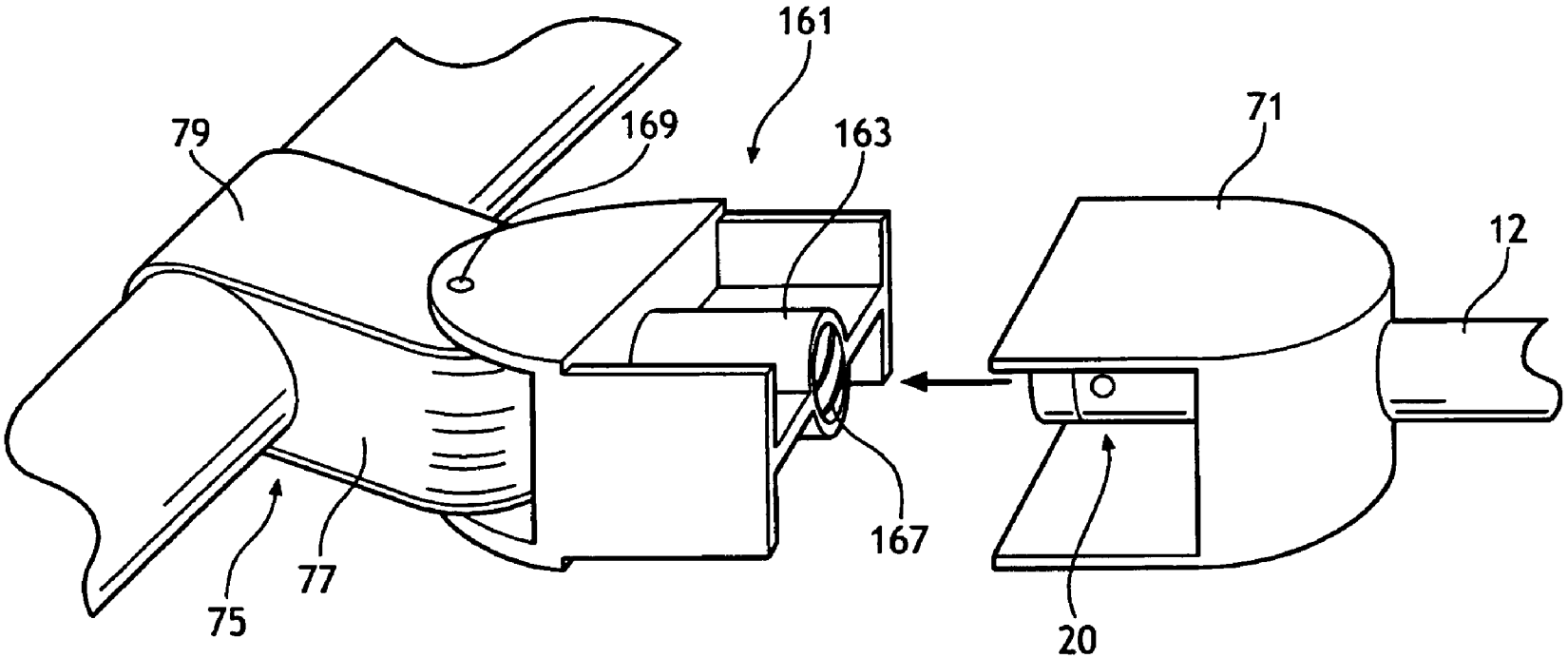
FIG. 8 is a partial perspective view of the head mount of the mop head of FIG. 1, the head mount positioned to engage the coupling assembly of the quick-release handle.

An example of a coupler shroud 71 and cooperating head mount 161 is shown in FIGS. 7 and 8. The illustrated coupler shroud 71 and the head mount 161 are cooperatively designed such that coupler shroud 71 fits within the head mount 161 and the heat mount 161 fits within the coupler shroud 71. Such a cooperative design ensures a snug and solid coupling of the mop head 100 attached to the head mount 161 and the handle 10. As such, the mop head 100 would be unable to rotate about the shaft axis. Additionally, such a head mount 161 along with the coupler shroud 71 could help protect the coupling assembly 20 from damage and minimize the contact the coupling assembly 20 has with the outside environment during use.

As shown in FIGS. 1, 2, 7 and 8, additional functionality may be added to a head mount 161 by including a head coupler 75. The head coupler 75 connects the head mount 161 to the traverse support shaft 151 of the mop head 100. The particular head coupler 75 shown in FIGS. 1, 2, 7 and 8 has a coupler bracket 79 that fits around a portion of the traverse support shaft 151. A coupler spacer 77 cooperates with the coupler bracket 79 to hold the coupler bracket 79 against the support shaft 151. A pin 169 through the head mount 161, coupler bracket 79, and the coupler spacer 77 couples the head mount 161 and head coupler 75.

The head coupler 75, illustrated in FIGS. 7 and 8, allows the head coupler 75, the attached head mount 161, and the coupled quick-release handle 10 to rotate about the traverse support shaft 151 and consequently allow the distal end 18 of the handle 10 to move vertically relative to the floor and the mop head 100. Additionally, the head coupler 75 is designed to interact with the head mount 161 such that the head mount 161 and coupled handle 10 may pivot on the pin 169 of the head coupler 75 such that the distal end 18 of the handle 10 may be pivoted from side-to-side, relative to the mop head 100.

To aid the user in grasping the handle 10, the distal end 18 may be equipped with a grip 41 and a knob 43. The grip 41 has a slightly larger diameter than the shaft 12 and is preferably made of material, or is otherwise designed, to facilitate grasping of the shaft 12. Additionally, such a grip 41 should be designed to have the necessary durability required for the typical use of such handle 10. For example, the grip 41 may be made of rubber, plastic, metal, or the like. Such materials may be given a texture through processing or through design by the addition of ridges, patterns, or divots to the surface of the grip 41 (as shown in FIGS. 9, 12A and 12B).

The grip 41, as shown in FIGS. 9, 12A, 12B and 13, may additionally have a knob 43 that also provides the user with more comfort than a traditional stick used with common brooms or mops. Generally, such traditional sticks merely have the end rounded off and cause fatigue to the user's hand and often result in blisters or calluses in the palm of the hand after extended use. The small diameter of the end of such traditional sticks causes discomfort and is often difficult for the user to fully grasp.

Figure 12A:
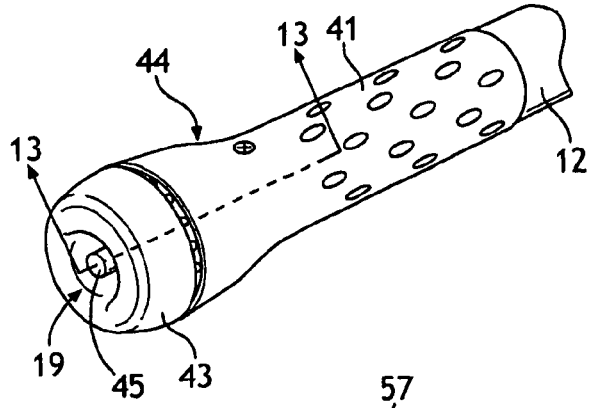
FIG. 12A is a partial perspective view of the distal end of the quick-release handle of FIG. 9 showing a grip, a freely-rotating knob, and a button actuator.
Figure 12B:
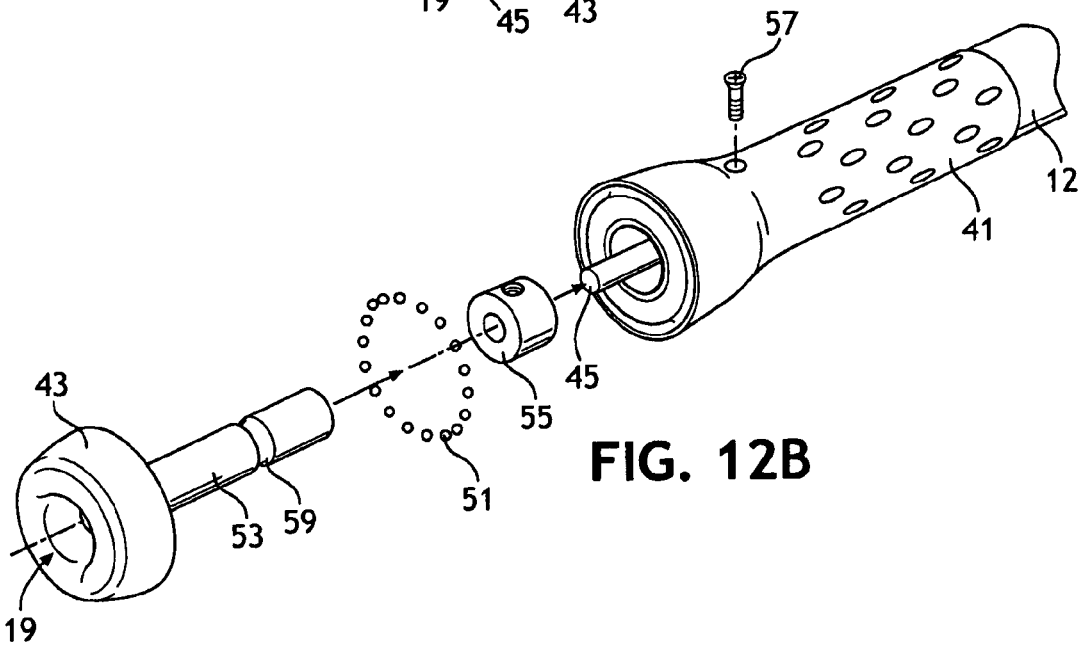
FIG. 12B is a partial perspective exploded view of the distal end of the quick-release handle of FIG. 12A.
Figure 13:
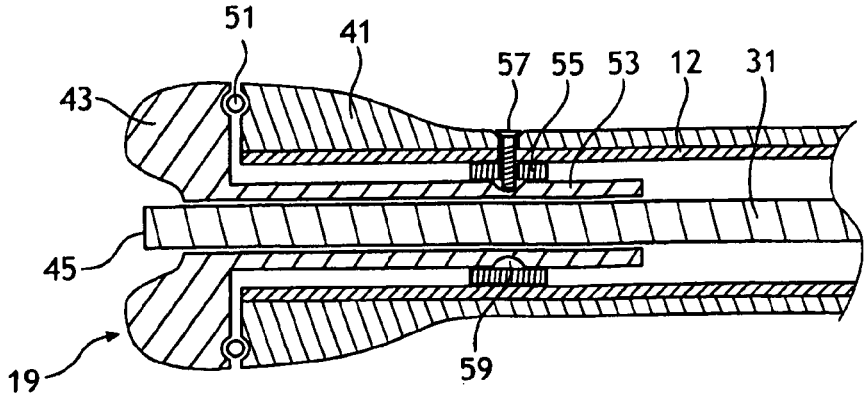
FIG. 13 is a cross-sectional view of the distal end of the quick-release handle of FIG. 12A taken along the line 13-13.

A knob 43 such as shown in FIGS. 12A, 12B and 13, provides the user with a much larger diameter end to the handle 10 compared to traditional sticks. The larger diameter of the knob 43, relative to traditional sticks makes the knob 43 much easier to grasp. By increasing the surface area of the distal end surface 19 of the knob 43, the forces experienced by the user's hand are spread out over a greater surface area than can be achieved by a rounded end of a traditional stick. Such a better distribution of forces result in a reduction in the amount of fatigue the user experience in their hand.

The knob 43 may be formed as a unitary part of the terminus of the grip 41 or it may be an additional part added to the distal end 18 of the shaft 12. The knob 43 shown in FIG.S. 12A, 12B and 13 is only intended to be an exemplary shape for such a knob 43; the knob 43 may be any size and shape, symmetrical or asymmetrical, that allows the user to comfortably grasp and utilize the handle 10.

As can be seen in FIGS. 9 and 12A, the shape of the knob 43 is extended to the grip 41 of the distal end 18 of the handle 10. This functional grab area 44 of the knob 43 allows a user to maintain a grip of the knob 43, when the user pushes the handle 10 away from their body. This is particularly useful in mopping when a user will regularly "cast out" a mop and then bring the handle 10 and mop back to themselves.

Additionally, the button actuator 45 is also present at the distal end 18 of the handle 10. As shown in FIGS. 12A and 13, the button actuator 45 is incorporated into the knob 43 and is recessed within the distal end surface 19. As such, the user may grasp the knob 43 during use without unintentionally depressing the button actuator 45 and accidentally releasing the mop head 100. The button actuator 45 shown in FIGS. 12A, 12B, and 13 is merely the terminus of the push rod 31. However, the button actuator 45 may be a separate piece attached or otherwise operably connected to the push rod 31

The knob 43, as shown in FIGS. 12A, 12B and 13, may additionally have the added ability to freely rotate 360-degrees on the terminus of the distal end 18 of the shaft 12. Such a freely-rotating knob 43 would reduce the rubbing and twisting that the user's hand experiences when using traditional sticks. By allowing the knob 43 to freely rotate, the user may maintain a grasp on the knob 43 during regular use of the tool and avoid the fatigue and blisters that often accompanied use of a traditional push broom, mop, or floor duster.

The rotation of the knob 43 may be accomplished with by any type of mechanical bearings, as are well known, that allow the desired 360-degrees of free rotation. By way of non-limiting examples, the rotation may be accomplished with sliding bearings or bushings, rolling-element bearings (such as ball bearings, roller bearings, taper roller bearings), fluid bearings, magnetic bearings, or the like. In the example shown in FIGS. 12A, 12B, and 13, the rotation of the knob 43 is accomplished with a track of ball bearings 51 that are held in place by cooperative recesses in both the end of the grip 41 and in the knob 43. The ball bearings 51 allow the knob 43 to freely-rotate a full 360-degrees about the axis of the shaft 12, on the end of the grip 41.

The assembly of the freely-rotating knob 43 is illustrated in FIGS. 12A, 12B and 13. A shaft sleeve 53 is associated with the knob 43 such that the shaft sleeve 53 fits over the push rod 31 when the knob 43 and associated shaft sleeve 53 are inserted into shaft 12. A knob-connecting collar 55 inserted into the shaft 12 fits around the shaft collar 53. A set screw 57 is inserted from the exterior of the handle 10, through the grip 41, through the shaft 12, and into the knob-connecting collar 55. As such, the set screw 57, holds the knob-connecting collar 55 in place within the interior of the shaft 12. When the knob 43 and associated shaft sleeve 53 are inserted into the shaft 12, the set screw 57 is aligned with a notch 59 circumscribed on the exterior of the shaft sleeve 53. With the set screw 57 in place within the notch 59, the knob 43 is held firmly in place on the terminus of the handle 10 and against the ball bearings 51. As such the knob 43 may freely rotate 360-degrees upon the ball bearings 51, the shaft sleeve 53 is allowed to also freely rotate within the shaft 12, and the knob 43 is kept from being pulled from the end of the handle 10.

Additionally, the shaft sleeve 53 has an interior diameter that allows the push rod 31 to pass through the shaft sleeve 53 such that knob 43 and shaft sleeve 53 may freely rotate about push rod 31. As shown in FIGS. 12A and 13, the button actuator 45 is recessed within the distal end surface 19. When in use, the knob 43 freely rotates about the button actuator 45 and push rod 31 without the risk of the user unintentionally depressing the button actuator 45 or the non-rotating button actuator 45 rubbing on the palm of the user's hand.

As an added benefit to the mop system of the present invention, the disposable cleaning substrate may be provided in a continuous web format. Such a continuous web format may provide a more conveniently stored than a multitude of individual cleaning substrates. Additionally, when users have more than one width of mop head 100, the continuous web of substrate could be configured to be a selectable-size substrate 85 such that user need only store one continuous web of substrate rather than multiple sizes of individual substrates.

Figure 14:
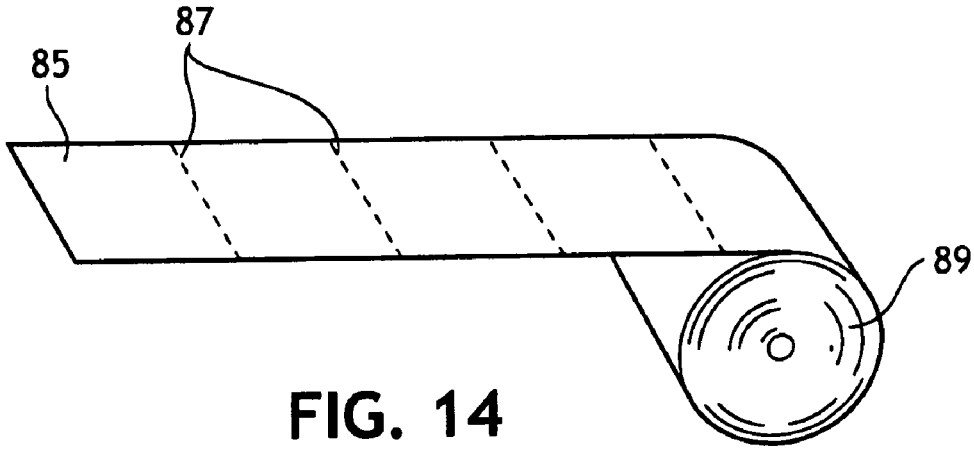
FIG. 14 is a perspective view of a continuous web of selectable-width cleaning substrate in a roll format.

As shown in FIG. 14, the continuous web of selectable-size substrate 85 may have lines of weakness 87 at regular intervals along the length of the web 85. Such lines of weakness 87 may be perforations, scoring, areas of weakened material, or other similar character that allows a portion of the cleaning substrate to be removed from the continuous web of substrate 85. The regular interval between the lines of weakness 87 would be an interval that would balance the needs of various widths of mop heads 100. For example, the system of the present invention may include floor mops having head widths of 12 inches (305 mm), 18 inches (457 mm), 24 inches (610 mm), 36 inches (914 mm), and 48 inches (1.2 m). In such a system, a selectable-size substrate 85 would preferably have lines of weakness 87 at 6-inch (152 mm) intervals. The user would then be able to easily tear off any appropriate length of substrate 85 for the particular width head that they were using.

Figure 15:
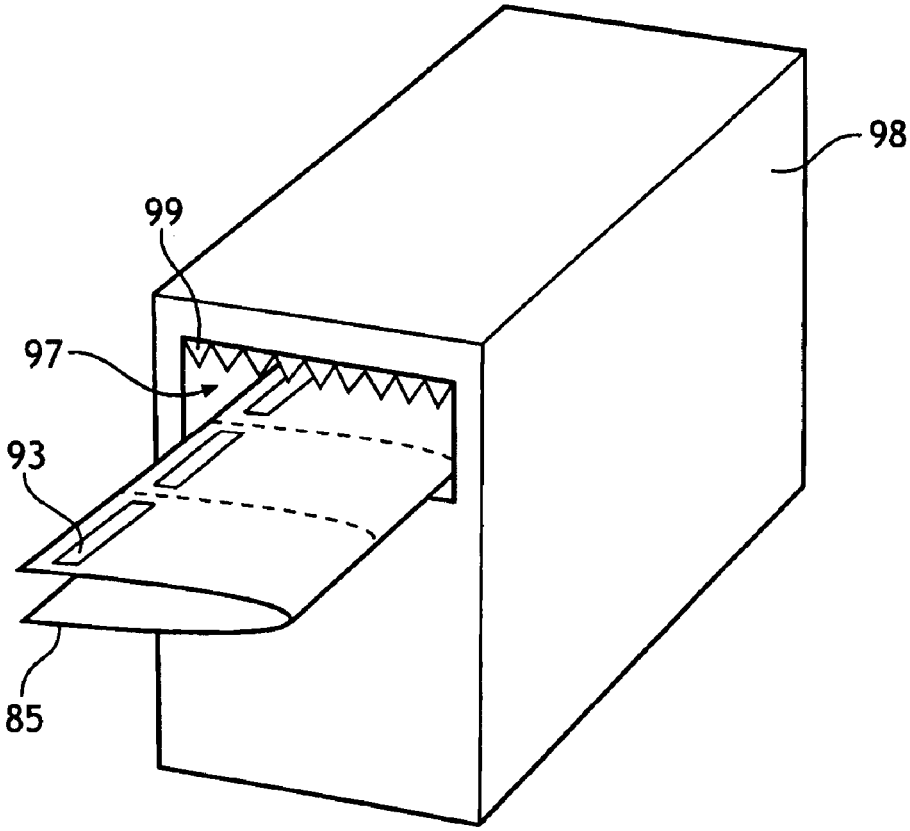
FIG. 15 is a perspective view of a continuous web of selectable-width cleaning substrate and disposed within a container.

Such disposable cleaning substrates may be a single flat sheet as shown in FIG. 14, a folded or two-ply sheet as shown in FIG. 15, a tubular substrate, or other formats that could be provided as a continuous web and as necessary for the various mop heads 100 widths of the system. As shown in FIG. 15, such substrates may additionally include substrate fasteners 93 that may interact with the particular mop heads 100 to attach the substrate to those mop heads 100.

The selectable-size substrate shown in FIG. 14 is provided in a roll format 89. As such, the roll 89 could be mounted in a roll product dispenser, as are commonly available and widely understood. Such a dispenser could be available on the wall, on a cart, or wherever would be most convenient for the user of the system. Alternatively, the selectable-size substrate 85 may be provided to the user in a container 98, such as shown in FIG. 15. The substrate 85 could be stored and dispensed from the container 98 through a dispensing opening 97 in the container 98. The substrate 85 may be available in the container 98 in any format that is desired. It may be a roll 89, as in FIG. 14, merely piled in the container 98, or may be festooned within the container 98.

Additional functionality could also be added to the container 98. As shown in FIG. 15, the container 98 may have a separator 99 that the user could use to more easily separate the cleaning substrate along the lines of weakness 87. Such containers 98 may also include indicia that would help the user identify the amount or type of substrate contained, instructions on proper use, disposal instructions, or other messages that are desired to be conveyed to the user. Such indicia may be any word(s), numeral(s), line(s), symbol(s), picture(s), color(s) and/or combination(s) thereof, that convey the desired message. Additionally, or alternatively, the container 98 may have additional features such as viewing slots such the user can see the amount of remaining substrate, mounting brackets for mounting the container 98 on a support surface, disposal/recycling features, or other such characteristics that enhance the system and make it easier to use.

It will be appreciated that the foregoing examples and discussion, given for purposes of illustration, are not to be construed as limiting the scope of this invention, which is defined by the following claims and all equivalents thereto.

We claim:

1. A reversible mop head assembly adapted for use with a mop handle, the mop head assembly comprising:

a transverse support shaft;

a pair of end caps, the end caps positioned at opposing ends of the transverse support shaft;

a lower substrate support surface comprising a front edge, a back edge, and a pair of opposing end edges;

an upper substrate support surface comprising a front edge, a back edge, and a pair of opposing end edges;

a head mount centrally positioned on the transverse support shaft between the end caps, the head mount configured to releaseably couple with a mop handle; and a pair of opposing wheels positioned on the central portion of the transverse support shaft with each wheel positioned on opposite sides of the head mount, wherein the end edges of the lower and upper substrate support surfaces are supported by the opposing end caps such that the back edges of both the lower and upper substrate support surfaces are proximate to the traverse support shaft.

2. The assembly of claim 1, wherein the lower substrate support surface comprises at least one fastener channel to receive and hold at least one replaceable fastener strip.

3. The assembly of claim 2, wherein the upper substrate support surface comprises at least one fastener channel to receive and hold at least one replaceable fastener strip.

4. The assembly of claim 1, wherein the upper and lower substrate support surfaces both comprise surfaces which are convexly curved between the front edge and the back edge.

5. The assembly of claim 1, wherein at least one of the front edge and back edge of at least one of the upper and lower substrate support surfaces comprises a curved lip.

6. The assembly of claim 1, wherein the head mount further comprises a socket mount, the socket mount configured to releaseably couple with a mop handle.

7. The assembly of claim 6, wherein the socket mount comprises threads.

8. The assembly of claim 1, wherein the pair of end caps comprises a moveable end cap and a fixed end cap, wherein the moveable end cap is configured to be disengaged from the upper and lower substrate support surfaces such that a sleeve substrate is positionable over the upper and lower substrate support surfaces.

9. The assembly of claim 8, wherein the moveable end cap comprises an end plate with a finger hold.

10. The assembly of claim 8, wherein the moveable end cap comprises a grip.

11. A reversible mop system comprising:

a transverse support shaft;

a pair of end caps, the end caps positioned at opposing ends of the transverse support shaft;

a lower substrate support surface comprising a front edge, a back edge, and a pair of opposing end edges;

an upper substrate support surface comprising a front edge, a back edge, and a pair of opposing end edges;

a head mount centrally positioned on the transverse support shaft between the end caps;

a pair of opposing wheels positioned on the central portion of the transverse support shaft with each wheel positioned on opposite sides of the head mount;

a mop handle; and a cleaning substrate positioned upon the lower and upper substrate support surfaces, wherein the head mount is configured to releaseably couple with the mop handle, and wherein the end edges of the lower and upper substrate support surfaces are supported by the opposing end caps such that the back edges of both the lower and upper substrate support surfaces are proximate to the traverse support shaft.

12. The system of claim 11, wherein the cleaning substrate comprises a sleeve substrate positioned upon the upper and lower substrate support surfaces.

13. The system of claim 11, wherein the mop handle comprises a quick-release handle, the quick-release handle comprising a proximal end proximate to the mop head and a distal end distal to the mop head; a quick-release coupling assembly positioned on the proximal end of the handle, the quick-release coupling assembly configured to releaseably couple the handle with the head mount; and a button actuator positioned on the distal end of the handle, the button actuator operably connected to the quick-release coupling assembly.

14. The system of claim 13, wherein the handle further comprises a coupler shroud positioned at the proximal end of the handle, the coupler shroud configured to cooperatively engage the head mount.

15. The system of claim 11, wherein the lower substrate support surface comprises at least one fastener channel to receive and hold at least one replaceable fastener strip.

16. The system of claim 15, wherein the upper substrate support surface comprises at least one fastener channel to receive and hold at least one replaceable fastener strip.

17. The system of claim 15, wherein the cleaning substrate comprises a fastener that cooperates with the fastener strip to couple the substrate with the lower substrate support surface.

18. The system of claim 11, wherein the upper substrate support surface comprises at least one fastener channel to receive and hold at least one replaceable fastener strip.

19. The system of claim 11, wherein the upper and lower substrate support surfaces both comprise surfaces which are convexly curved between their front edges and their back edges.

20. The system of claim 11, wherein the cleaning substrate comprises a continuous web of cleaning substrate, the continuous web comprising lines of weakness at regular intervals such that various widths of cleaning substrate are removable via the lines of weakness.

* * * * *